US008702574B2

(12) United States Patent
Abranchess

(10) Patent No.: US 8,702,574 B2
(45) Date of Patent: Apr. 22, 2014

(54) METHOD AND SYSTEM FOR PERFORMING LINEAR AND CIRCULAR MOVEMENT PATTERNS

(76) Inventor: Dama Claudy Abranchess, Manassas, VA (US)

( * ) Notice: Subject to any disclaimer, the term of this patent is extended or adjusted under 35 U.S.C. 154(b) by 686 days.

(21) Appl. No.: 12/771,438

(22) Filed: Apr. 30, 2010

(65) Prior Publication Data

US 2010/0317496 A1 Dec. 16, 2010

Related U.S. Application Data

(60) Provisional application No. 61/213,043, filed on May 1, 2009.

(51) Int. Cl.
*A63B 21/00* (2006.01)
*A63B 26/00* (2006.01)

(52) U.S. Cl.
USPC ..... 482/141; 482/148

(58) Field of Classification Search
USPC ..... 482/51, 140–142, 70–71, 148
See application file for complete search history.

(56) References Cited

U.S. PATENT DOCUMENTS

| | | | | |
|---|---|---|---|---|
| 4,134,584 | A | 1/1979 | Rosenbusch | |
| 4,610,448 | A | 9/1986 | Hill | |
| 4,700,945 | A * | 10/1987 | Rader | 482/132 |
| 4,892,305 | A * | 1/1990 | Lynch | 482/132 |
| 6,129,651 | A | 10/2000 | Denaro | |
| 6,186,930 | B1 | 2/2001 | Ignaczak | |
| 6,219,845 | B1 * | 4/2001 | Ferriter | 2/24 |
| 6,942,605 | B1 * | 9/2005 | Sukhovitsky | 482/132 |
| 7,468,025 | B2 * | 12/2008 | Hauser et al. | 482/141 |
| 7,553,267 | B1 | 6/2009 | Hauser et al. | |
| 7,621,858 | B2 * | 11/2009 | Sheron | 482/132 |
| 7,681,248 | B2 * | 3/2010 | Legenstein | 2/24 |
| 7,935,040 | B2 * | 5/2011 | Moskowich | 482/141 |
| 7,951,053 | B1 * | 5/2011 | Christian | 482/132 |
| 7,972,251 | B2 * | 7/2011 | Peddar | 482/132 |
| 7,981,016 | B1 * | 7/2011 | Howard | 482/141 |
| 7,998,043 | B2 * | 8/2011 | Zhou et al. | 482/139 |
| 8,016,732 | B2 * | 9/2011 | Susnjara | 482/142 |
| D654,545 | S * | 2/2012 | Richard | D21/662 |
| 2004/0108074 | A1 * | 6/2004 | Marchetti | 156/468 |
| 2005/0245372 | A1 * | 11/2005 | Mylrea et al. | 482/148 |
| 2007/0004558 | A1 * | 1/2007 | Johansson | 482/1 |
| 2007/0287605 | A1 | 12/2007 | Mylrea et al. | |
| 2009/0186750 | A1 | 7/2009 | Hauser et al. | |
| 2009/0186751 | A1 | 7/2009 | Hauser et al. | |

FOREIGN PATENT DOCUMENTS

| | | |
|---|---|---|
| CA | 2 441 777 | 3/2005 |
| FR | 2 883 194 | 9/2006 |
| GB | 2 198 961 | 12/1987 |
| WO | 2008/003057 | 1/2008 |

OTHER PUBLICATIONS

International Seach Report—PCT/US/2010/033358—Nov. 25, 2010.

* cited by examiner

*Primary Examiner* — Stephen Crow
(74) *Attorney, Agent, or Firm* — Young & Thompson

(57) ABSTRACT

A method and system for performing linear and circular movement patterns is provided. The method and the system include a limb-activated linearly and circularly moveable apparatus comprising a rotatable platform coupled to a slideable base. A limb gripping the apparatus can slide the apparatus across a surface while rotating the platform. The apparatus is designed to constantly realign the joints involved in the movements and without straining the joints of the body to maximize productivity and promote joint comfort.

32 Claims, 18 Drawing Sheets

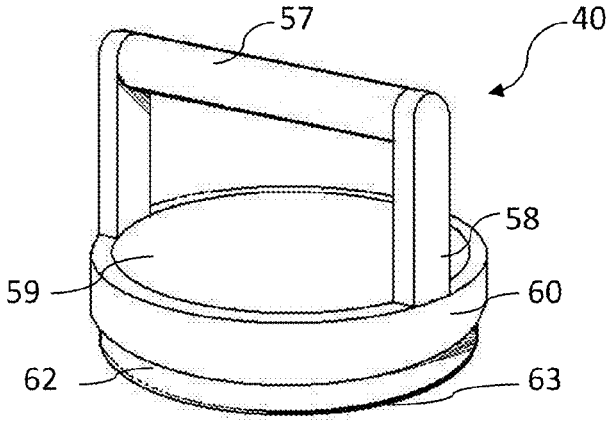
FIG. 1
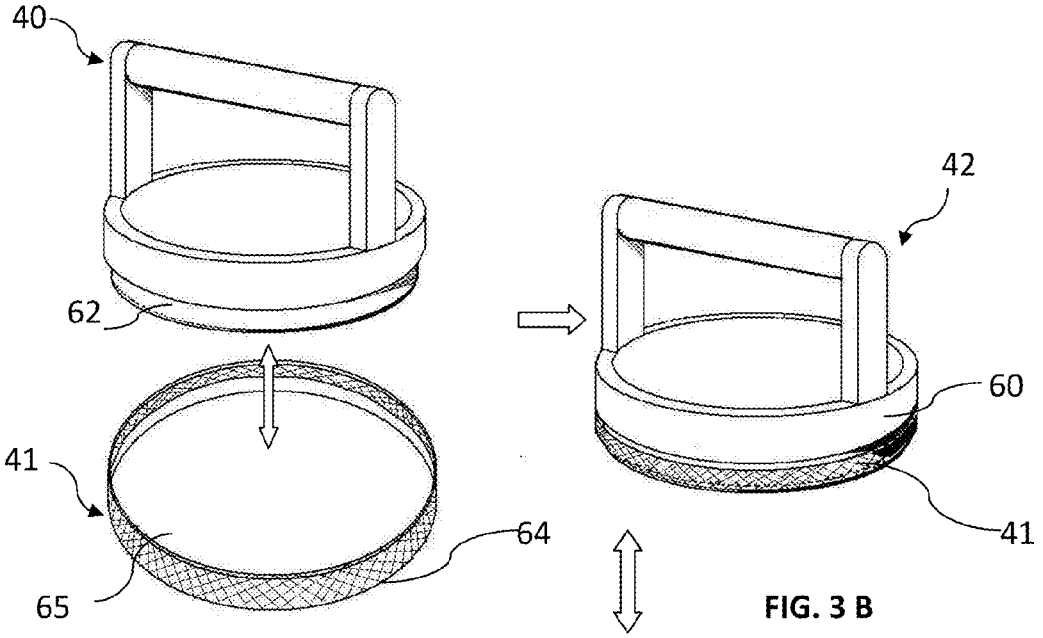
FIG. 3 A
FIG. 3 B
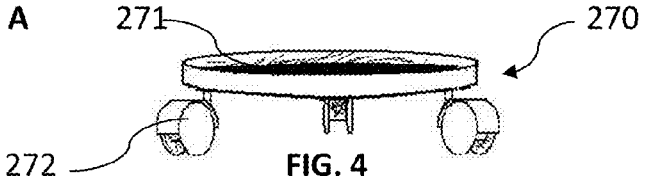
FIG. 4

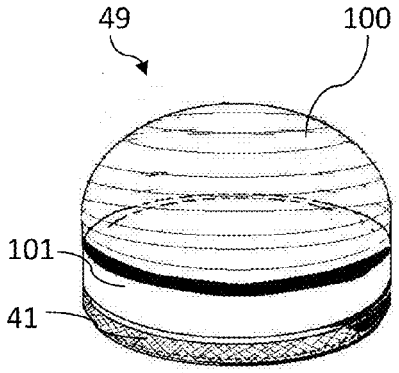
FIG.31
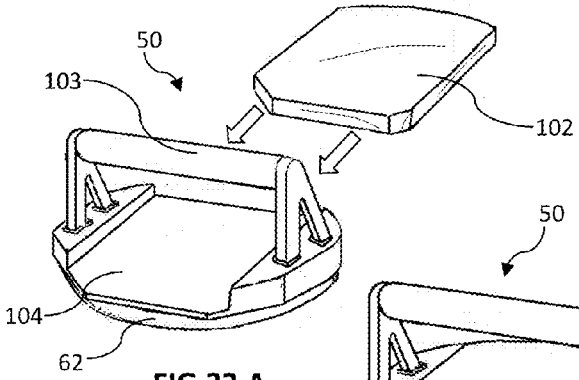
FIG.32.A
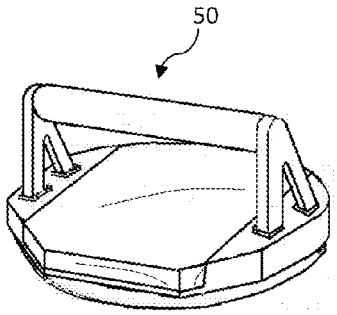
FIG.32.B
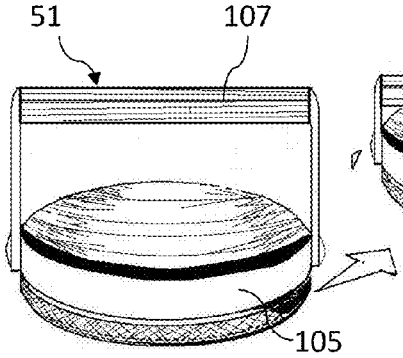
FIG.33.A
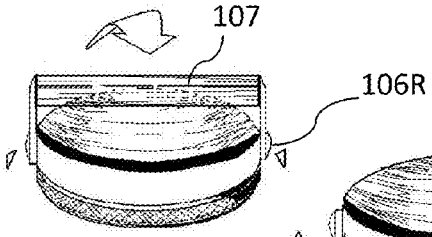
FIG.33.B
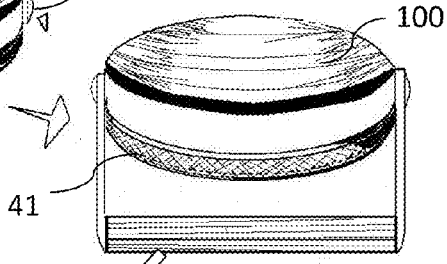
FIG.33.C
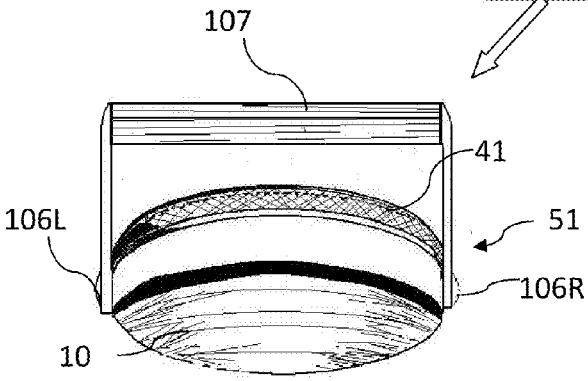
FIG.33.D

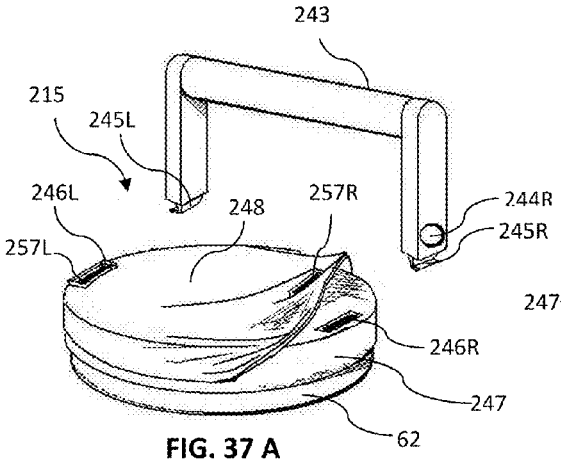
FIG. 37 A
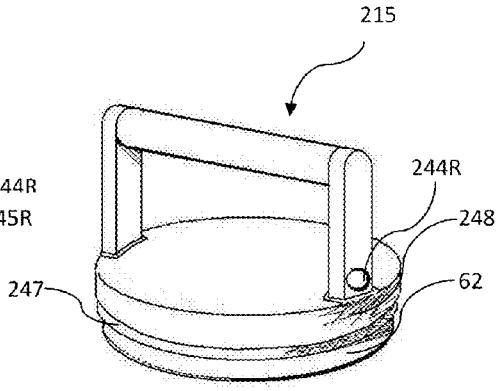
FIG. 37 B
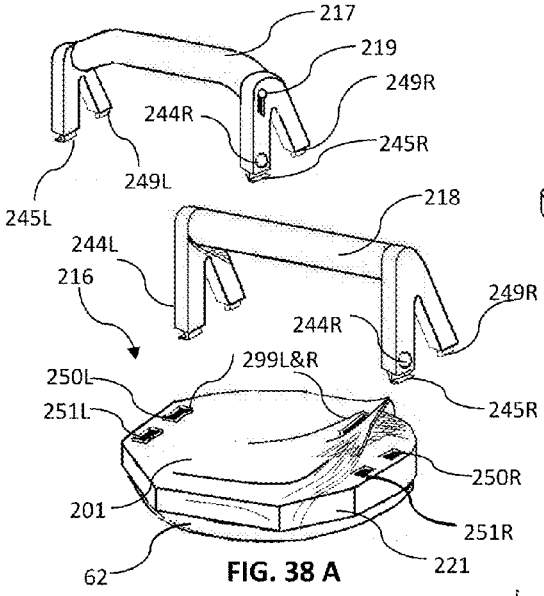
FIG. 38 A
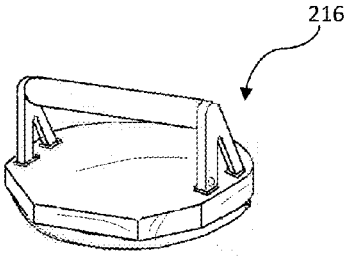
FIG. 38. B
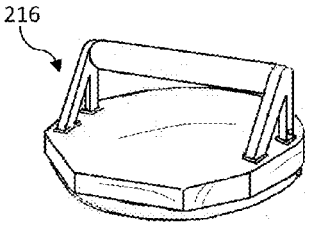
FIG. 38 C
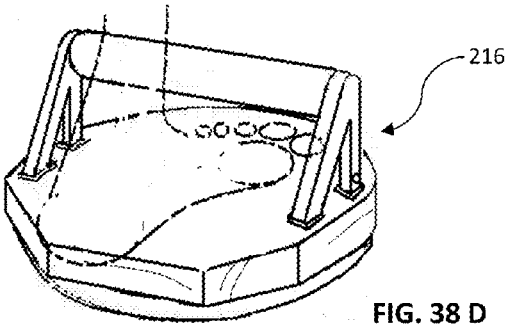
FIG. 38 D

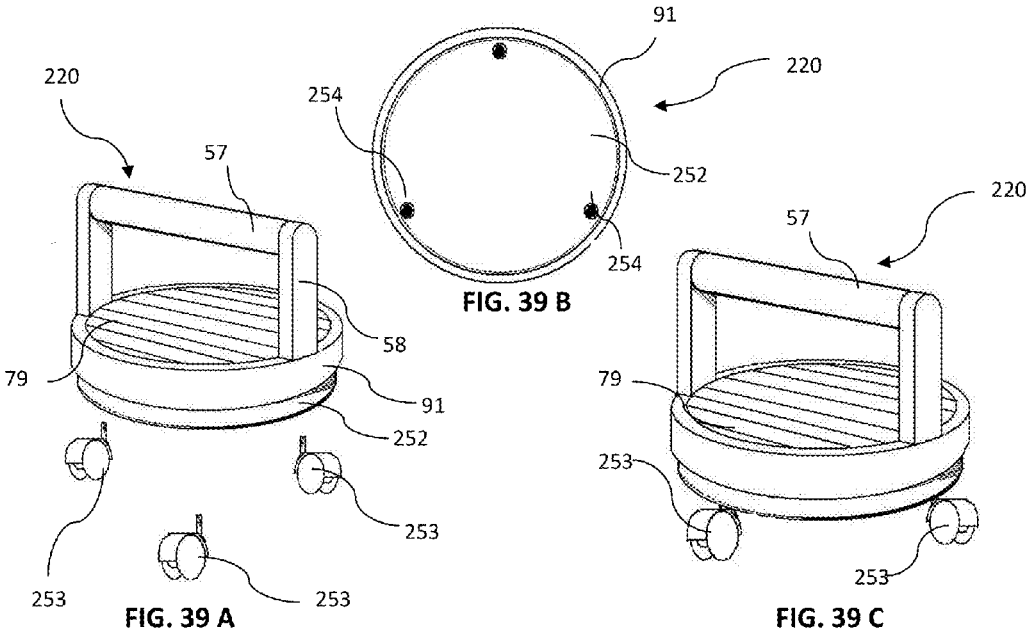
FIG. 39 A
FIG. 39 B
FIG. 39 C
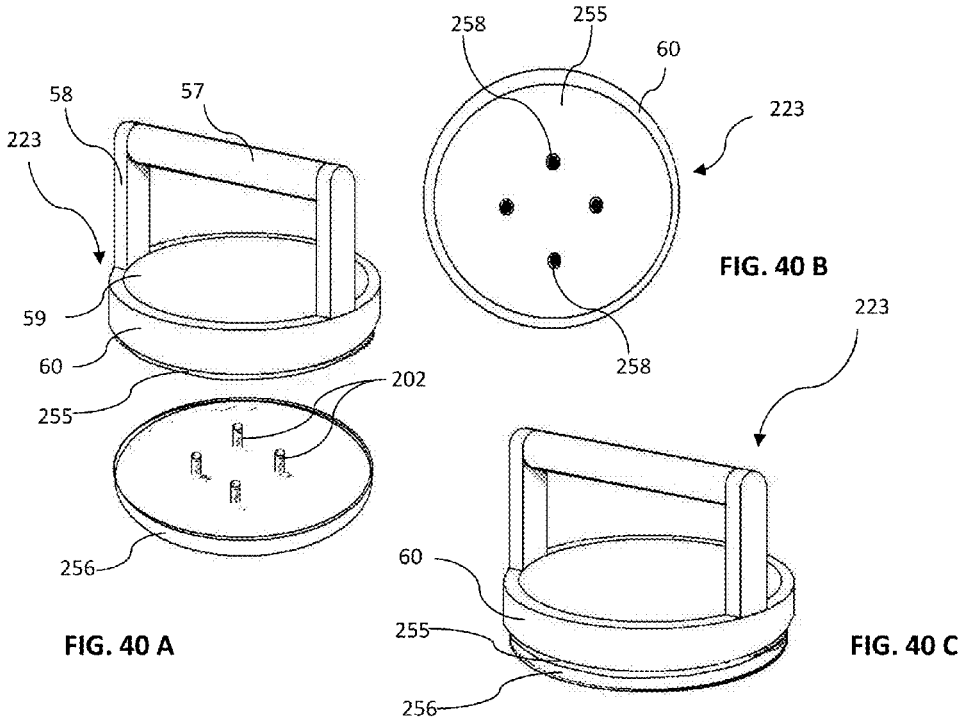
FIG. 40 A
FIG. 40 B
FIG. 40 C

METHOD AND SYSTEM FOR PERFORMING LINEAR AND CIRCULAR MOVEMENT PATTERNS

CROSS-REFERENCE TO RELATED APPLICATIONS

This application claims the benefit of U.S. Provisional Application 61/213,043 filed May 1, 2009.

FIELD OF THE INVENTION

The present invention relates to a method and a system for a human to perform linear and circular movement patterns with an apparatus engineered to help realign the joints involved in the movements to maximize force output and to promote joint comfort.

BACKGROUND OF THE INVENTION

Activities of daily life have been improved with multiple products that unfortunately have done a poor job of protecting the joints and promoting their realignment during movements. The products suffer by locking or limiting the mobility of the body joints. Such products can cause injuries due to unnecessary strain on the joints, muscle imbalance and pain.

The skeletal system and the muscle groups that are designed to promote movement of the human body are run by the brain and the nervous system that pass on commands for each motion performed by the human body. In order to maximize the force output and efficiency of the movement, the joints involved should be perfectly aligned so that the signal from the brain to the muscle is not interrupted by different factors, such as joint pain, that signals the brain that the movement must be stopped or the joints realigned to protect the body from injury.

Various reasons can cause the body to move at less than the optimum ability or potential. Using products that position the body improperly can lead to interruption of the movement or cause muscle imbalances to develop, leading to injuries and discomfort. People who suffer from joint aches such as arthritis, tendonitis, bursitis, or any other type of joint disease, also have a serious disadvantage and can have a hard time using products that cause pain and discomfort.

Fitness and exercise has been the answer to gain muscle strength and promote a stronger and more efficient body. Some exercise products attempt to mimic training for everyday activities. Many exercise machines, however, focus on a single muscle group or a single plane of motion, thus somewhat limiting the improvements made to the body. The human body is made to move in multiple planes of motion at different speeds that should be trained in a safe progressive manner in order to best prepare the body for everyday challenges.

Fitness and exercise will be used as the primary topic of the disclosure herein. That is to be taken and understood as exemplary to demonstrate how a method and a system with joint realignment based design will benefit a user from movement enhancement, safety, efficiency, and overall quality of daily activities. Nevertheless, movement improvement based on joint realignment will benefit other aspects of life including, for example, washing, dusting, painting, cleaning, gardening, grooming, ironing, sweeping, vacuuming, mopping, buffing, waxing, exercising and more.

With a lack of time to exercise, many people turn to different apparatuses with the hope of getting fast results. Many will realize that being out of shape for a certain period of time has weakened them and most of the machines are challenging or too uncomfortable on their joints. Joint pain becomes an issue and it can be difficult to apply enough strength to perform some exercise. Biomechanics and the laws of physics teach that the skeletal system needs to have its joints perfectly aligned to produce maximum force and avoid joint discomfort during a movement. There is a need for a method and system that helps realign the joints during a movement, in all planes of motion and on any type of surface.

Modern science also teaches that movement based exercise training is more beneficial to the body because it challenges the body to perform at different speeds and following different movement patterns that involve different muscle groups. It is important to note that movements involving multiple joints moved at multiple speeds in different patterns, and that involve different muscle groups to work together in different systems, promote body stability, balance, realignment, and coordination. This type of movement-based training is called functional training, where the body is forced to use proprioception, which is the unconscious perception of movement and spatial orientation arising from stimuli within the body. This type of stimulation improves balance and stability of the body by using the ability of the brain to memorize movement patterns to create coordination between different muscle groups to stabilize the body and produce the correct amount of force output to create a movement or motion.

Everyday life is full of such challenges and exercising with stable machines in the gym does not challenge the body enough to benefit balance and stability. Those machines are also bulky, very costly and for the most part target one muscle group through a single joint. Muscle isolation promotes the muscle but does little for the ability of the brain to promote movement or memorize movement patterns. There exists a need for a method and system that promotes functional training to train the muscles in less time, and to better prepare the body against injuries. There is a need for a method and system that can facilitate functional training to promote balance, stability, coordination, strength and cardio through a solid full body workout.

One class of portable exercising apparatuses is the Hand-Held Wheeled Exercise Apparatus described in US 2008/0070762. This apparatus allows stretching and exercising by rolling the apparatus on the floor. The apparatus can only be rolled linearly in a straight line and is limited to mainly stretching and exercising the upper body and core muscles. Attempting to use the apparatus in a circular pattern puts pressure on the joints from the wrist to the elbow and the shoulders putting the user at risk of injury. The muscles in the lower parts of the body are also neglected. There is a need for an apparatus that can roll or slide in every direction and in all planes of motion and a method and system to do so without straining the joints by providing joint realignment during the movement.

Another class of portable exercising apparatus is the Exercise Apparatus, U.S. Pat. No. 4,768,778, the Pushup Exercise Apparatus, U.S. Pat. No. 7,377,888, and the Push-Up Exercise Unit and Apparatus, U.S. Pat. No. 7,468,025 and U.S. Pat. No. 7,553,267. These apparatuses work by rotating the handles in either clockwise or counter clockwise directions while the user is performing a push-up movement. These apparatuses do a good job of protecting the wrist and elbow joints but the bottom surface of the apparatuses are made of a slip resistant material so that the apparatus remains completely stationary during movement. These apparatuses are designed to work in a vertical range of motion for the upper body, and primarily work the wrist, chest, shoulders, triceps and biceps. The muscles of the back and the lower body are not exercised. There is a need for an apparatus that can help perform more than just push-ups in a single plane of motion, and a need for a method and system that can provide exercises for the lower extremities, core and upper body while rolling or sliding in multiple directions and in circular patterns on different surfaces.

The method and apparatus described in U.S. patent application Ser. No. 10/958,190, works by allowing the user to place a body part on a sliding element and to slide that body part to stretch and/or exercise in different directions. Because there is no handle on the sliding element to provide a secure grip, it limits the amount of force applied by the hand, for example, to return to a starting position after a stretch and/or exercise. This also limits how far the muscle involved can be stretched as well as the range of motion. Furthermore, it exerts pressure on the joints in the wrist and the ankles because there is no rotation of the sliding element. There is a need for a system and method that promotes joint realignment to allow the body to stretch further. There is a need for a reliable system to secure a body limb on an apparatus to allow maximum force to be used to bring the apparatus back from the stretched position to the starting position while safely exercising the muscle stretched, and for performing circular and linear movement patterns in all planes of motion.

SUMMARY OF THE INVENTION

The present invention relates to a linear and circular movement system, comprising a limb-activated, linearly and circularly moveable apparatus. The apparatus includes a gripping device adapted for gripping by a limb, such as a hand and/or a foot, a rotatable platform connected to the gripping device, the platform being rotatable by a first movement of the limb, a pivoting element connected to the platform, and a sliding base connected to the pivoting element. The base is slideable across a contacted surface, the base being slideable by a second movement of the limb, wherein by the first and second movements of the limb the gripping device actuates the platform and base to realize both linear and circular motion of the apparatus with respect to the contacted surface.

The method and system of the present invention allows a user to slide and/or roll at least one apparatus away from and back toward the body in multiple directions, following a linear and/or circular movement pattern in all planes of motion, while moving a limb of the body secured to the apparatus. The method includes performing movement patterns executed by a user in different planes of motion with a great range of motion and the constant realignment of the joints involved in the movements.

The method and system of the present invention involves securing a limb, such as a hand and/or a foot, onto the apparatus, then moving the limb in multiple directions while progressively realigning the joints involved in the circular and/or linear movement pattern in all planes of motion. The method and system will be described in the context below as exercising and/or stretching in circular and or linear movement patterns in all planes of motion.

According to various embodiments, the method and system of the present invention provides a method of exercising the human body. The method includes performing one or more exercises using the linear and circular movement system. The exercise basically involves positioning an apparatus on a surface, such as an exercise floor, so that the sliding base of the apparatus is in contact with the surface. The apparatus is gripped with at least one limb of the body, such as a hand or a foot, and the limb is moved to slide/and or roll the apparatus in a linear or circular motion across the surface. The method and system of the present invention allows a user to perform exercises in any position, for example, a prone position, supine position, side-lying position, kneeling position, seated position, and standing position.

According to various embodiments, the method and system of the present invention can include more than one apparatus, such as two, three, four or more apparatuses. For example, the movement system can comprise four apparatuses, and two apparatuses can have a gripping device adapted for gripping by a foot, and two apparatuses can have a gripping device adapted for gripping by a hand. A user can position two apparatuses on the surface and grip the apparatuses with, for example, two hands, two feet, or a hand an a foot. In performing an exercise, the user can simultaneously slide both apparatuses, or can alternate sliding each apparatus.

According to various embodiments of the apparatus, the slideable base can include one or more multidirectional wheels mounted to the base and adapted to roll on the surface. In some embodiments, the apparatus can include a gripping device such as a handle that is pivotable, collapsible, and/or detachable. In some embodiments, the slideable base can be removable from the apparatus and/or interchangeable. The system can include a variety of bases and each base can provide a different coefficient of friction with the contacted surface. Removable bases also can provide an easy system for replacing the slideable base and can provide a variety of design patterns or colors.

According to various embodiments, the apparatus can include a gripping device such as the handle that can be configured, positioned, and or adjusted on the apparatus to vary the amount of space to receive a limb of the body. For example, the gripping device can be configured and positioned to accommodate a hand, and then adjusted to better accommodate a foot or a knee. The gripping device can be offset to different positions on the apparatus. The handle of the gripping device can be offset, for example, by collapsing, pivoting, sliding and/or detaching from one set of receiving sockets to another set of receiving sockets. In one embodiment, the base on each side of a detachable handle can be adapted to offset the handle by pivoting or flipping the handle 180 degrees horizontally and reattaching to the apparatus.

According to various embodiments, the apparatus can include a gripping device comprising a detachable pad that is made out off a cushioning material with a slip resistant surface to comfortably secure a limb of the body such as a foot, a hand or a knee, to the apparatus. The detachable cushioned pad can be detached from the apparatus and placed on the floor, for example, to serve as a knee-pad.

According to various embodiments, the method and system can include one or more strap, such as an elastic resistance band, connected to the apparatus. The one or more strap can connect two apparatuses to each other.

The method and system of the present invention can be used for different types of training such as strength training, balance, stability, flexibility, Pilates, yoga, and speed training. The method and system can be used by a single user or by a large group of users. The apparatus can be used in multiple ways that can be taught to one individual or to a group of people, for example, at a seminar or a gym class.

The method and system is designed so that any human can use it. The apparatus includes a sliding or rolling base that when in contact with a surface, for example, an exercise floor, the contacted surfaces have a friction coefficient low enough to permit essentially any human user to slide or roll the apparatus across the surface. According to various embodiments, the movement system includes apparatuses having various friction coefficients that provide various degrees of sliding or rolling resistance. For exemplary purposes only, an embodiment of the system would allow a 150 pound person of average strength and mobility to slide and/or roll an apparatus across an exercise floor surface when the apparatus is pressed at an oblique angle. The system can be safely used by any human from a young age to senior citizens and from post-injury rehab to more advanced athletic users.

BRIEF DESCRIPTION OF THE DRAWINGS

FIG. 1 illustrates a perspective view of an embodiment of the apparatus used in the inventive method and system.

FIGS. 3A and 3B illustrate a perspective view of an embodiment of the apparatus used in the inventive method and system.

FIG. 4 illustrates a removable wheeled base used in an embodiment of the inventive method and system.

FIGS. 22A and 22B illustrate a single leg mount climber with circular patterns and using a single apparatus according to the inventive method and system.

FIG. 31 illustrates a perspective view of an alternative embodiment of the inventive method and system with a half Swiss ball platform shape incorporated on the apparatus.

FIGS. 32A and 32B illustrates a perspective view of an alternative embodiment of the inventive method and system with an apparatus having a removable slip resistant pad made out of a cushioning material that can be adapted to use as a kneeling pad.

FIGS. 33A, 33B, 33C and 33D illustrate a perspective view of an alternative embodiment of the inventive method and system with an apparatus having a half Swiss ball platform shape and a gripping bar that can pivot to allow using both sides of the apparatus.

FIGS. 37A and 37B illustrate a perspective view of an alternative embodiment of the inventive method and system with an apparatus having a removable slip resistant mat that extends down to cover the platform and a removable hand gripping bar that can secure the mat and can be removed to allow changing the mat.

FIGS. 38A, 38B, 38C and 38D illustrate a perspective view of an alternative embodiment of the inventive method and system with an apparatus having a removable gripping bar. The gripping bar can have an offset base to be secured on the apparatus in a foot gripping position and/or a hand gripping position. The handheld gripping bar can include a vibrating system built in.

FIGS. 39A, 39B and 39C illustrate a perspective view of an alternative embodiment of the inventive method and system with removable multidirectional wheels.

FIGS. 40A, 40B and 40C illustrate a perspective view of an alternative embodiment of the inventive method and system with an apparatus having a removable sliding base.

DETAILED DESCRIPTION OF THE INVENTION

Figure 2:
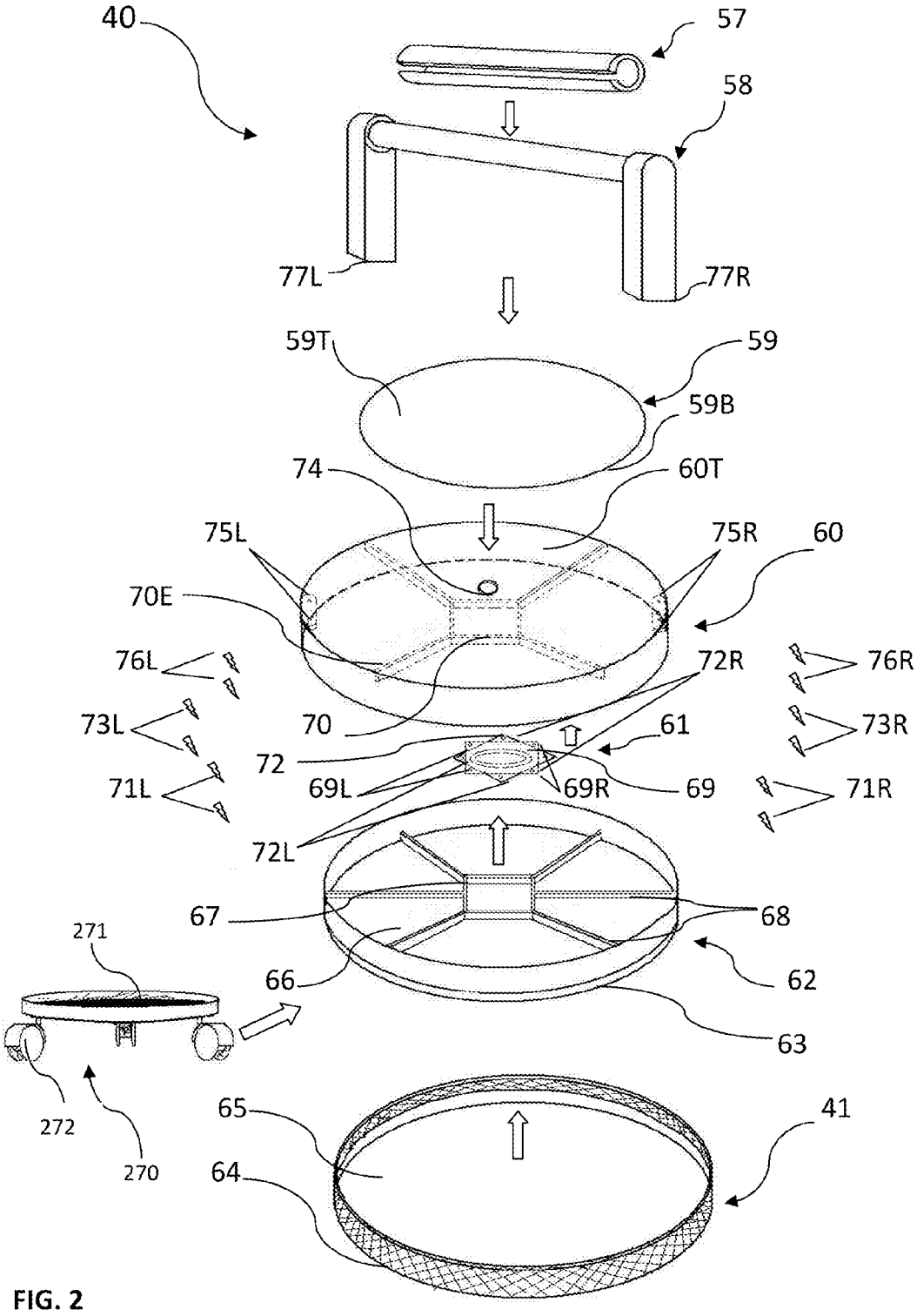
FIG. 2 provides an exploded view of an embodiment of the apparatus used in the inventive method and system.

In the method and system of the present invention, different movement patterns can be executed by a user with a great range of motion. When a user slides the apparatus, the rotation of the platform with respect to the base allows for a constant realignment of the joints during the movement. By rotating the platform with respect to the base, circular movement patterns can be performed in different planes of motion without straining the joints. The apparatus allows the user to stretch and/or exercise linear and circular movement patterns to stretch muscle groups as far eccentrically as possible and back concentrically from multiple directions while realigning the joints for maximum force output and comfort.

Referring to FIG. 1, the linear and circular movement system of the present invention includes a limb-activated, linearly and circularly moveable apparatus 40. Apparatus 40 comprises a rotatable platform 60, rotatably mounted or connected to a sliding base 62. Apparatus 40 also comprises a gripping device adapted for gripping by a limb. In this embodiment, the gripping device includes a gripping bar 58 connected to platform 60. Gripping bar 58 can also include a slip resistant grip 57 positioned on the bar for gripping, for example, by a hand. Apparatus 40 can also include a slip resistant mat 59 with a slip resistant surface positioned on platform 60 to receive the limb. The slip resistant surface of mat 59 can provide a surface for gripping, for example, by a foot, a hand or a knee.

Apparatus 40 includes a pivoting element connected to platform 60 and to sliding base 62 so that platform 60 and base 62 are rotatably coupled through the pivoting element. Platform 60 and base 62 can be rotatably coupled using, for example, ball bearing plates, however, any of various well known ways of rotatably coupling two pieces together, such as bearings, a lazy-susan, or a swivel mechanism can be used. Platform 60 can be rotated with respect to base 62 by a first movement of the limb gripping the gripping device. For example, a hand on gripping bar 58 can rotate platform 60 with respect to base 62. In another example, a foot placed on mat 59 can rotate platform 60 with respect to base 62.

Base 62 is designed to be slideable across a contacted surface, such as the floor. In particular, the bottom 63 of base 62 is designed to slide on a surface, for example an exercise floor. Base 62 is slideable across the surface by a second movement with the limb gripping the gripping device. In combination, the first and second movements of the limb gripping the gripping device actuates platform 60 and base 62 to realize both linear and circular motion of apparatus 40 with respect to the contacted surface.

Referring to FIG. 2, gripping bar 58 can be mounted on platform 60. Gripping bar 58 can be U-shaped and is connected to platform 60 at two connection points, the extremities 77L and 77R. The top of platform 60T can be designed to receive removable fasteners 76L and 76R from the bottom of platform 60 through openings 75L and 75R to removably secure extremities 77L and 77R. In some embodiments, extremities 77L and 77R can have a wider base or can be offset so provide more room for a limb such as a foot or a knee (see also, FIG. 32 and FIG. 38). Gripping bar 58 can also have alternative ways of being secured on apparatus 40, for example, to be collapsible, removable, and/or integrated into platform 60. Gripping bar 58 can be built into platform 60 in a unitary construction. Gripping bar 58 can also be pivotable along an axis defined by the two connection points.

In FIG. 2, gripping bar 58 has an inverted U-shape, but other shapes can be used such as a C-shape, a J-shape, a Z-shape, an S-shape, and an L-shape. The base of the inverted U has a slip resistant grip 57 that can be adapted for gripping by a user's hand and to provide a comfortable and reliable grip on apparatus 40. Accordingly, gripping bar 58 can have an inside length of, for example, about 6½ inches, an outside length of about 8 inches, a height of about 4¼ inches and an extremity width of about 1½ inches. Grip 57 can have a cylindrical shape that covers most of the length on the inside of gripping bar 58. Grip 57 can also have different shapes such as finger grooves for conforming to the shape of the user's hand and fingers. Grip 57 can also be removable from gripping bar 58.

Platform 60 is made out of a strong, rigid material such as wood, rubber, metal, plastic, polymers and/or composites, or the like. Platform 60 is designed to support and/or receive a limb of the body, such as a hand, foot or knee. The bottom of platform 60 is rotatably mounted to the top of base 62 through a pivoting element, such as through ball bearing plates 61. In the embodiment shown in FIG. 2, base 62 and platform 60 are circular and the diameter of base 62 is smaller than the diameter of platform 60. When coupled together, platform 60 can turn with little or no friction with respect to base 62. Platform 60 can have a circular shape, for example, with a diameter of about 8 inches and a height of about 1 inch, however, other shapes and sizes can be used such as a square, a triangle, or any polygon.

According to various embodiments, platform 60 can include a central foundation 70 with extensions 70E designed to reinforce platform 60. Formation 70 can be designed to receive and secure ball bearing plates 61 on each corner of formation 70, for example, by fastening an upper bearing plate 69 through openings 69L and 69R, using fasteners 71 R and 71 L. A lower bearing plate 72 can similarly be attached to an internal central foundation 67 of base 62, for example, through openings 72L and 72R using fasteners 73L and 73R. The top of platform 60T can be designed with at least one opening 74 for access to fasteners 73L and 73R and internal square 67. Mat 59 is placed on top of platform 60 and can cover opening 74.

According to various embodiments, mat 59 can receive at least one foot or at least one hand. Mat 59 can cover the entire platform 60 and can have a pattern on the surface to provide extra grip by design. Mat 59 can be secured onto platform 60 with glue, or by other techniques such as fasteners, pins, or the like. Mat 59 can be removable and place on the floor to serve as a kneeling pad (See FIG. 32). Mat 59 can be made out of a soft and cushioning material to provide comfort on a limb such as a foot, a hand or a knee (See FIG. 32). Mat 59 can be made out of a non-slip material, for example, rubber, plastic, foam or fabric. In some embodiments, a slip resistant pattern mold on the top of platform 60 can serve a similar function as slip resistant mat 59 (see also, FIG. 26). Platform 60 can comprise indentations adapted to receive and secure the limb gripping the gripping device. Platform 60 can be shaped to accommodate a footrest designed to receive the foot, for example, the bottom of the foot, the heel, or the toes. The foot, heel and toe rests can be, for example, engraved small holes or indentations with different shapes designed to receive the appropriate portion of the foot (see also, FIG. 5B).

According to various embodiments, base 62 includes a bottom surface 63 designed and/or adapted to slide on an exercising surface in multiple directions. Base 62 can have a circular shape, for example, about 7½ inch in diameter and 1 inch in height. The base can have a diameter which is smaller than the diameter of platform 60. Base 62 can have a cylindrical shape with the top diameter equal to the bottom diameter. It is understood by those of ordinary skill in the art, however, that sliding bottom surface 63 can have a different shape on the outside such as a circle, a square, a triangle, or a polygon.

The top 66 of base 62 is rotatably coupled to the bottom of platform 60. Base 62 is connected to a pivoting element, such as ball bearing plate 61. Base 62 can include a central square shape foundation 67 designed to receive and secure lower bearing plate 72 through openings 72L and 72R with fasteners 73L and 73R. Base 62 can include alternative designs to accommodate alternative pivoting elements such as a swivel support base apparatus or a swivel mechanism. Any design of the inside of base 62 can be acceptable as long as base 62 rotates with respect to platform 60 with minimal or no friction allowing for a smooth rotation. Extensions 68 between central foundation 67 and the inner circumference of base 62 are designed to reinforce base 62.

Base 62 includes a bottom surface 63 that is designed to slide on a smooth surface such as an exercise floor. The surface 63 of sliding base 62 can comprise, for example, nylon, polyethylene, or polypropylene so that apparatus 40 can slide on any surface, such as hardwood, mirror, glossy hard floor, glossy plastic mat, rubberized floor, linoleum, and carpet. Base 62 is made out of a strong, rigid material such as wood, rubber, metal, plastic, polymers and/or composites or the like.

Base 62 can be removable from apparatus 40. A variety of removable bases can provide, for example, different coefficients of friction to vary the amount of resistance. Also, a removable base offers an advantage of being a replaceable base with the same coefficient of friction. A removable base can also provide the user with a selection of different colors or decorative patterns, for esthetic purposes (see also FIG. 40). Base 62 can be secured on the apparatus in multiple ways, for example with fasteners, plugs, and screws.

According to various embodiments, apparatus 40 can comprise a removable boot 41. As also illustrated in FIGS. 3A and 3B, the inside of boot 41 is adapted to receive base 62 of apparatus 40. For example, the boot 41 can have a circular shape with an inside diameter that is slightly larger than the outside diameter of base 62. In this way, boot 41 can be secured to apparatus 40 without falling off if apparatus 40 is picked up. The height of boot 41 can be slightly less than the height of base 62 that sticks out of platform 60, so that when boot 41 is secured on apparatus 40, there is enough space remaining between the bottom of platform 60 and boot 41 to allow rotation without being in contact. The inside shape of boot 41 can be altered according to the outside shape of base 62 so that boot 41 can be secured on apparatus 40.

According to various embodiments, boot 41 comprises a plastic cup 65 and a nylon sheet 64 covering the bottom of cup 65. An alternative to a nylon sheet is cloth of a material strong enough not to rip when sliding apparatus 40, but also with a friction coefficient to allow sliding on an exercise surface. Other material can be used such as polyethylene, polypropylene, cotton fabric and the like.

Depending upon the friction coefficient of the material, the bottom surface of apparatus 40 can be adjusted to provide for the ideal friction coefficient, creating different levels of resistance. For example, nylon with a gloss surface has a different friction coefficient than cotton fabric, and thus the different materials can provide for the ideal friction coefficient and/or resistance level of boot 41.

According to various embodiments, and as illustrated in FIG. 4, apparatus 40 can comprise a wheeled base 270 having one or more multidirectional wheel 272 adapted to roll on the contacted surface. One or more multidirectional wheel 272 can be mounted directly to base 62 or they can be mounted to wheeled base 270 that is separate from base 62. Wheeled base 270 can be removable and can have a top 271 with a diameter large enough to receive and secure to base 62 so that when picked up base 270 remains secure on apparatus 40. Wheeled base 270 can be adapted to roll on a slip resistant surface such as a rubber surface, cement, concrete, asphalt, and the like. Wheels 272 can be made with a desired friction coefficient allowing apparatus 40 to roll at a desired speed so the user can have control rolling away and back. Wheels 272 can be made of any material with a desired friction coefficient, for example, rubber, or a material with a gritty or abrasive surface, or with a slip resistant pattern engraved into the wheels. Depending on the desired friction coefficient, wheeled base 270 can allow apparatus 40 to roll on slip resistant surfaces as well as less slip resistant glossy hard surfaces and soft surfaces. Depending on the friction coefficient of the material used for wheels 272, a different level of resistance can be used from wheeled base 270 having wheels that will roll harder or easier to bring different levels of difficulty to the movement system.

Wheels 272 can be multidirectional and have a diameter, for example, of about one inch, but they can have larger or smaller diameters. Wheels 272 can be secured and mounted on a vertical rotating axle fastened into base 270 so that wheels 272 can freely rotate on the vertical axle and turn on their own axis making them multidirectional. Apparatus 40 offers the option of plugging and unplugging wheeled base 270 on to slideable base 62, but further designs offer plugging and removing wheels 272 on a base 62 having openings to receive the wheels (see also, FIGS. 39A-39C).

The method and system of the present invention allows for constant realignment of the joints involved in the movement. This results in the user having less strain on the joints and more comfort during a stretch or exercise. Realignment of the joints also provides greater force output due to faster joint stabilization prior to a movement. The same process enhances strength through the stabilization of the joints, in addition to a further stretch on the muscles involved, allowing bigger overload during the exercise and gains in muscle flexibility. The increased range of motion allows the user to stretch muscles by sliding an apparatus further out and returning to the starting position choosing linear or circular pathways without stressing the joints. The muscles can be stretched and exercised in one movement involving the core muscles to benefit the user's fitness by gaining strength, flexibility, balance, stability and coordination.

For the purpose of illustrating and better understanding the present invention, there is shown in the accompanying drawings different exercises and stretches using the method and system of the present invention. The exercises and stretches have been selected to demonstrate the variety of exercises and stretches contemplated by the present invention. It should be understood by those of ordinary skill in the art, however, that the system and method of the present invention is not limited to the exercises and stretches disclosed herein. It is evident that one of ordinary skill in the art can create additional exercises and numerous exercises routines, as well as apply the invention to other fields of activities.

FIGS. 5-24 illustrate various embodiments of the method and system of the present invention to perform a variety of stretches and exercises, each stretch or exercise including sliding an apparatus on a surface by moving a limb of the body secured onto the apparatus. The stretches and/or exercises can include, for example (i) pull stretches and/or exercises involving upper body muscle groups such as the forearms, biceps, upper back, lower back and rear deltoid, (ii) push stretches and/or exercises involving upper body muscle groups such as triceps, pectoral muscles, and front deltoid, (iii) push-pull stretches and/or exercises involving major and minor core muscle groups such as major muscles such as the pelvic floor muscles, transverse abdominals, multifidus, internal and external obliques, rectus abdominals, erector spinal (sacrospinalis), longissimus thoracic, and the diaphragm, and minor core muscles such as latissimus dorsi, gluteus maximus, and trapezes, and (iv) one or more push-pull/flexion-extension stretches and/or exercises, involving lower body muscle groups such as hip flexors, semimembranosus, semitendinosus, biceps femoral, gracilis, sartorius, popliteus, gastrocnemius, quadriceps, ankle flexors and extensors.

Figure 5A:
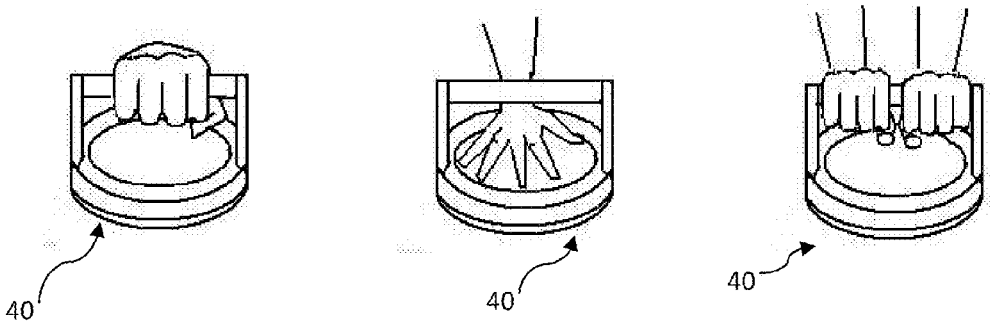
FIG. 5A illustrates different ways to grasp an apparatus of the inventive method and system using one hand or both hands.
Figure 5B:
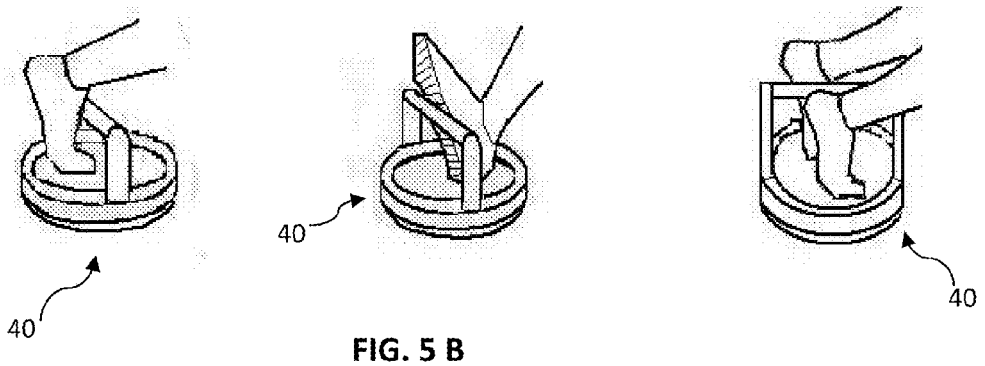
FIG. 5B illustrates different ways to grasp an apparatus of the inventive method and system using one foot or both feet.

FIGS. 5A and 5B illustrate various embodiments of apparatus 40 held in different ways such as one hand on a gripping bar, one hand on a slip resistant mat, both hands on a gripping bar, one foot with the toes on a slip resistant mat, one foot with the heels on a slip resistant mat, both feet with the toes on a slip resistant mat and both feet with the heels on a slip resistant mat (not shown) ready to perform a stretch and/or an exercise according to the method and system of the invention.

During all circular and linear sliding patterns, platform 60 rotates with respect to base 62 while the feet and/or the hands are secured on platform 60 to avoid friction on the joints to maximize the force output of the arms and legs exercised and/or stretched.

Figure 6A:
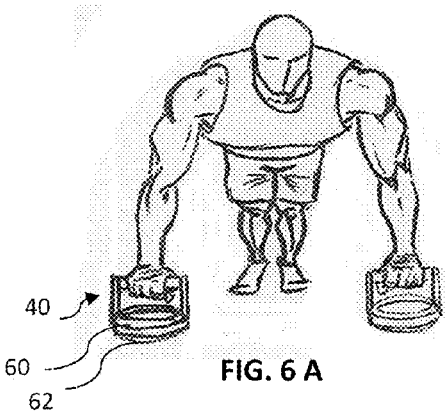
FIGS. 6A and 6B illustrate a push-up exercise according to the inventive method and system.

FIGS. 6A-6F illustrate several push-up style exercises according to the inventive method and system. These exercises start from a basic push-up position holding an apparatus 40 on each hand, feet and together and palms of the hands facing the feet, as shown in FIG. 6A.

Figure 6B:
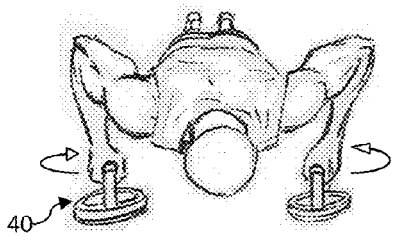

In FIG. 6B, the user progressively lowers the torso by bending the elbows and twisting the wrists outward down to a final stretching position before pushing up the torso back to the starting position while twisting the wrists inward. During the push, gripping bar 58 of apparatus 40 stays perpendicular to both arms and platform 60 rotates with respect to base 62 so there is no discomfort on the wrists and elbows.

Figure 6C:
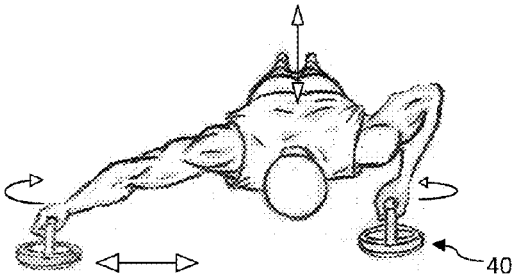
FIG. 6C illustrates a single arm push-up and single arm chest fly combo according to the inventive method and system.

FIG. 6C illustrates a single arm push-up and single arm chest fly combo. The user progressively lowers the torso by bending the left elbow and sliding apparatus 40 of the right hand while twisting the wrists outward to bring the body down to a stretching position with the right arm sliding out perpendicular to the body. The user then returns back up to the starting position by pulling and sliding apparatus 40 back to shoulder width level. The user can then switch movements to the other hand to complete the second repetition of the exercise. The push and the pull are done at the same time so the torso is always parallel to the exercise floor.

Figure 6D:
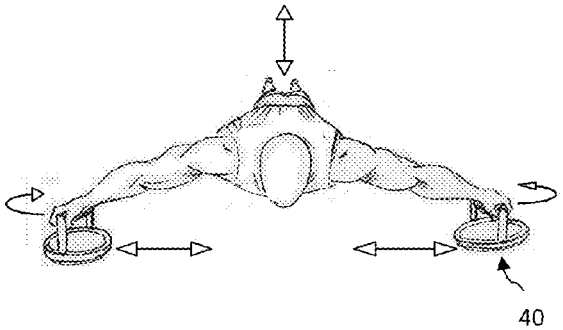
FIG. 6D illustrates a prone chest fly according to the inventive method and system.

FIG. 6D illustrates a prone chest fly. In this exercise, the user progressively lowers the torso by linearly sliding out both apparatuses 40 with the elbows slightly bent and the arms perpendicular to the body while twisting the wrists outward. The user then pulls apparatuses 40 back in to shoulder width while twisting the wrists inward to push the torso back up to the prone position. The push and the pull are done at the same time so the torso is parallel to the exercise floor at all time.

Figure 6E:
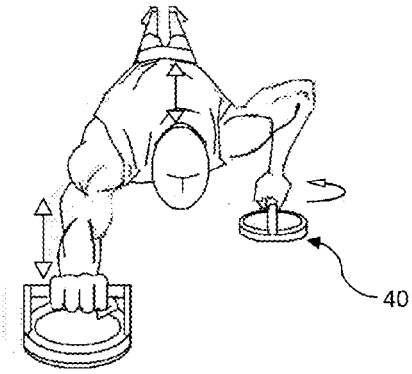
FIG. 6E illustrates a single arm push-up and a single arm pull combo according to the inventive method and system.

FIG. 6E illustrates a single arm push-up and a single arm pull combo. The user progressively lowers the torso by linearly sliding forward apparatus 40 with the elbow slightly bent. The user then linearly pulls apparatus 40 back in to shoulder width level to push the torso back up to the prone position. The user can switch to the other hand or he can finish pulling with one hand for the number of repetitions desired and then start back with the other hand.

Figure 6F:
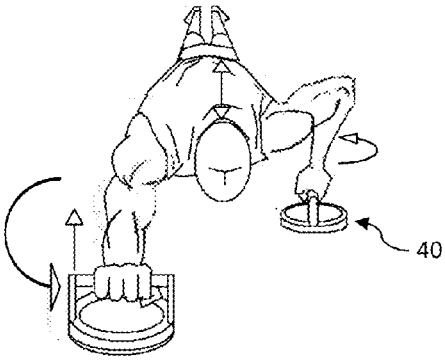
FIG. 6F illustrates a single arm push-up and a single arm butterfly combo according to the inventive method and system.

FIG. 6F illustrates a single arm push-up and a single arm butterfly combo. The user progressively lowers the torso by circularly sliding forward apparatus 40 in a "C" pattern. The user then linearly pulls apparatus 40 of the right hand back to shoulder width level to push the torso back up to the prone position.

Figure 7A:
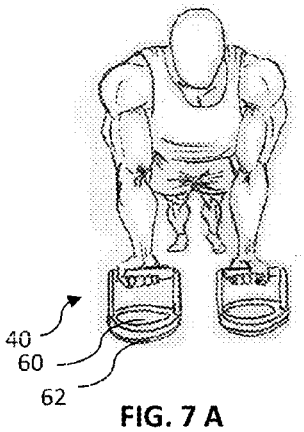
FIGS. 7A and 7B illustrate a prone chest press starting with the palms facing out according to the inventive method and system.
Figure 7B:
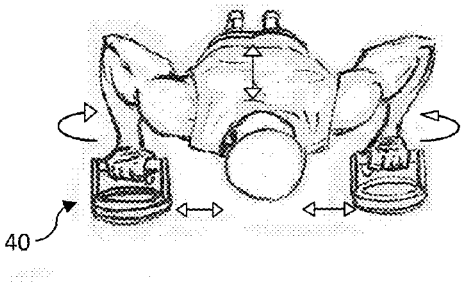

FIGS. 7A and 7B illustrate a prone chest press starting with the palms facing out. This exercise is shown starting from the push-up position holding two apparatuses 40, one on each hand close together with feet shoulder width apart and palms of the hands facing out with the thumbs perpendicular to the body. The user progressively lowers the torso to the prone stretching position by bending the elbows and linearly sliding out both apparatus 40 while twisting the wrists inward. The user then twists the wrists outward and linearly slides apparatus 40 and push-up the torso back to the prone position.

Figure 8A:
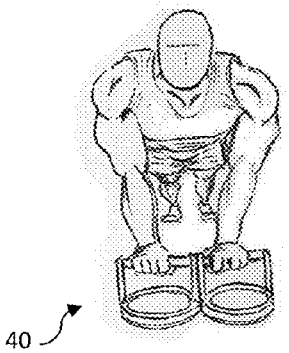
FIGS. 8A and 8B illustrate a prone chest press starting with the palms facing in towards the feet according to the inventive method and system.
Figure 8B:
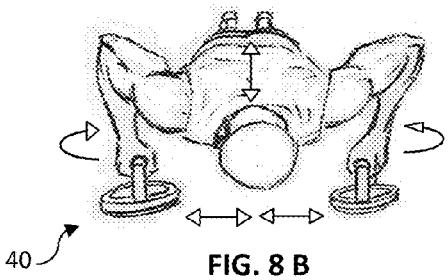

FIGS. 8A and 8B illustrate a prone chest press starting with the palms facing in towards the feet. The user progressively lowers the torso to the prone stretching position and linearly sliding out two apparatuses 40 while twisting the wrists inward so the thumbs are parallel to the body. The user then twists the wrists outward, and linearly slides in the apparatuses 40 and push-up the torso back to the prone position.

Figure 9A:
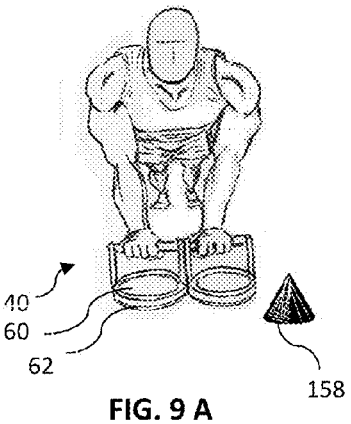
FIGS. 9A, 9B and 9C illustrate a crab slide according to the inventive method and system.
Figure 9B:
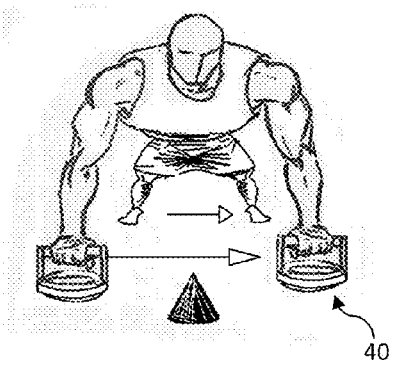
Figure 9C:
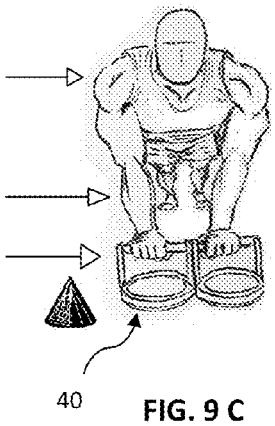

FIGS. 9A, 9B and 9C illustrate a crab slide exercise. This exercise begins in the push-up stance and on the right side of a cone 158 and ends in the same position but on the left side of cone 158. The user slides apparatus 40 of the left hand out along with stepping out with the left foot to a new push-up stance so cone 158 is in the middle between both hands. The user then slides in apparatus 40 of the right hand along with stepping the right foot to the push-up stance with both apparatuses 40 and both feet together while moving the body to the left side of the cone 158.

Figure 10A:
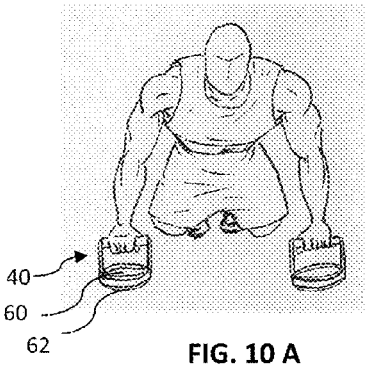
FIGS. 10A and 10B illustrate a chest fly on the knees according to the present invention.
Figure 10B:
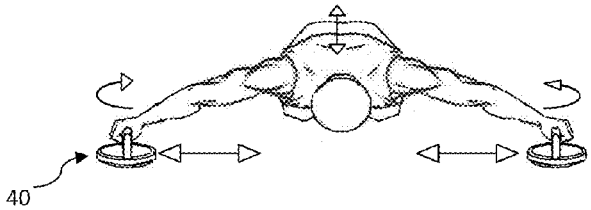

FIGS. 10A and 10B illustrate a chest fly on the knees in a semi-kneeling position. This exercise starts in a semi-kneeling position with the knees on the floor and both arms extended with the torso parallel to the exercise floor. The user then progressively lowers the torso by linearly sliding out both apparatuses 40 with the elbows slightly bent and both arms perpendicular to the body while twisting the wrists outward and stretching down to the semi-kneeling prone position. The user then pulls apparatuses 40 back in while twisting the wrists inward to push the torso back up to the semi-kneeling prone position.

Figure 10C:
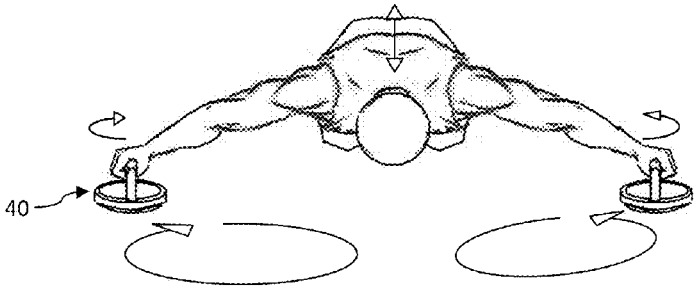
FIG. 10C illustrates a butterfly on the knees according to the inventive method and system.

FIG. 10C illustrates a butterfly on both knees. This exercise starts at a semi-kneeling prone position with the knees on the floor and both arms extended with the torso parallel to the floor. The user then progressively lowers the torso by circularly sliding out both apparatuses 40 with both arms perpendicular to gripping bar 58 while twisting the wrists outward and stretching down to the semi-kneeling prone position. The user then circularly slides back apparatuses 40 while twisting the wrists inward to push the torso back up to the semi-kneeling prone position.

Figure 11A:
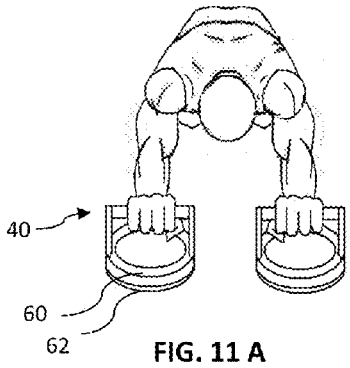
FIGS. 11A and 11B illustrate a lateral arm push-out/pull-in on the knees according to the inventive method and system.
Figure 11B:
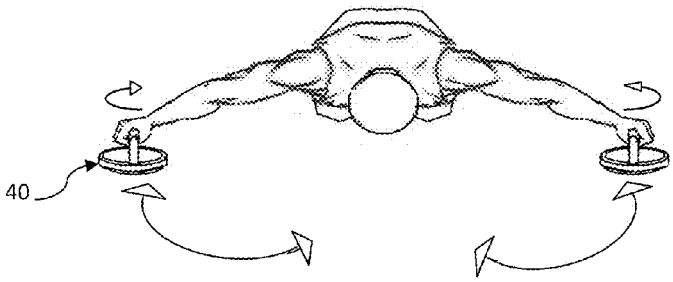

FIGS. 11A and 11B illustrate a lateral arm pull-out/pull-in on the knees in the semi-kneeling prone position. This exercise starts at a semi-kneeling prone position with the knees on the exercise floor and both arms extended out in front and parallel to the body. The user pulls out on apparatuses 40 to circularly slide both arms from a parallel position in front of the body to a perpendicular position beside the body to the semi-kneeling prone position. The user then pulls in on apparatuses 40 to circularly slide the arms from the perpendicular position back to the parallel position in front of his body.

Figure 12A:
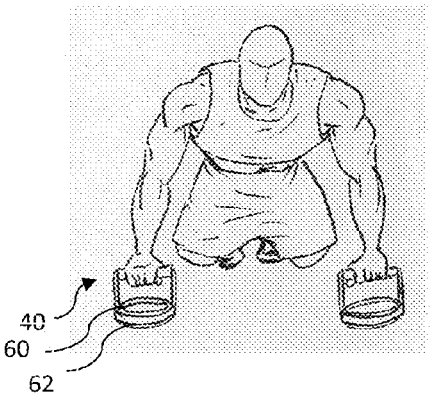
FIGS. 12A and 12B illustrate a horizontal arm pull-in/push-out combine with an abs slide on the knees according to the inventive method and system.
Figure 12B:
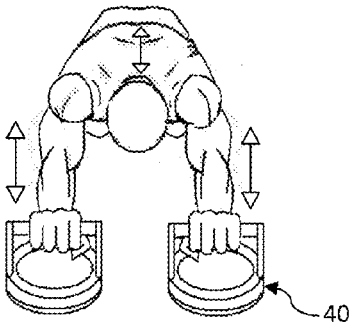

FIGS. 12A and 12B illustrate a horizontal arm pull-in/push-out combine with an abs slide on both knees. The user progressively lowers the torso by linearly sliding out both apparatuses 40 with the arms parallel to the body down to the semi-kneeling prone position. The user then linearly slides back apparatuses 40 and pushes up the torso back to the semi-kneeling prone position.

Figure 13A:
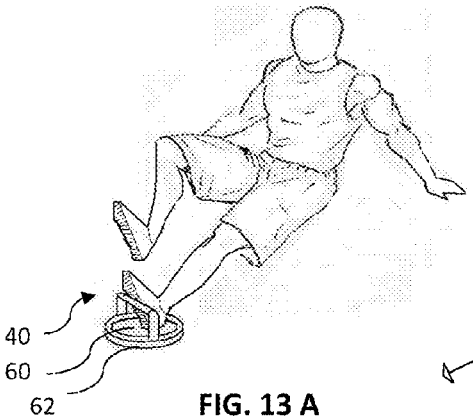
FIGS. 13A and 13B illustrate a seated linear leg curl and extension for one leg according to the inventive method and system.
Figure 13B:
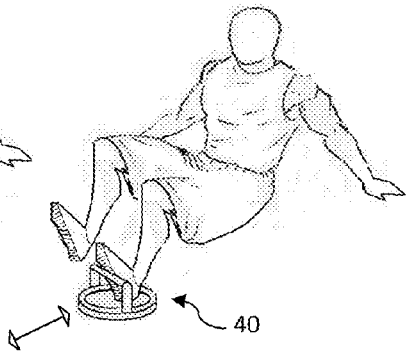

FIGS. 13A and 13B illustrate a seated linear leg curl and extension for one leg. This exercise starts in a seated position with the right knee flexed, both hands on the exercise floor to support the torso and the left knee extended with the left heel on apparatus 40. The user bends the left knee by linearly sliding apparatus 40 to curl the left heel to the seated position. He then extends the left knee by linearly sliding apparatus 40 to push the left heel out to the seated position.

Figure 13C:
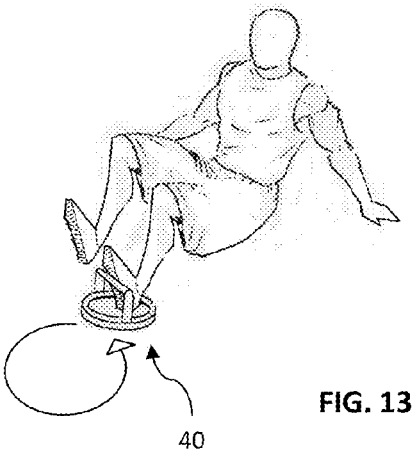
FIG. 13C illustrates a seated circular leg curl and extension for one leg according to the inventive method and system.
Figure 14:
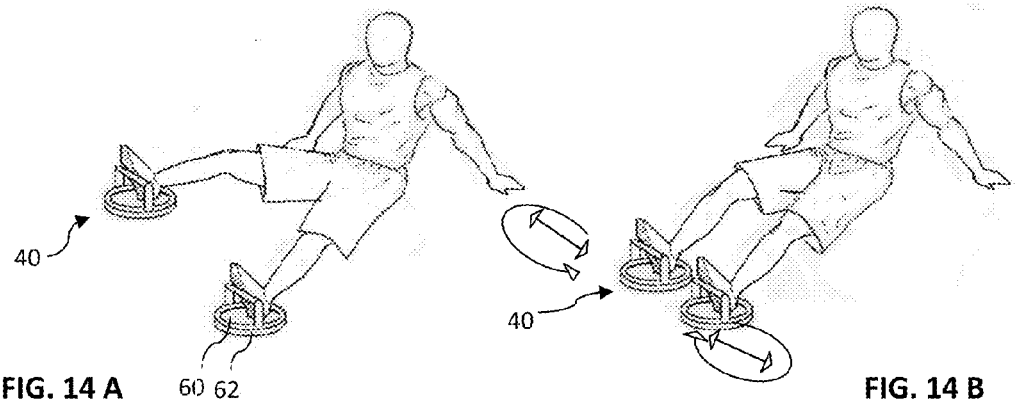
FIGS. 14A and 14B illustrate a seated adductor/abductor and lower abs exercise according to the inventive method and system.
Figure 15:
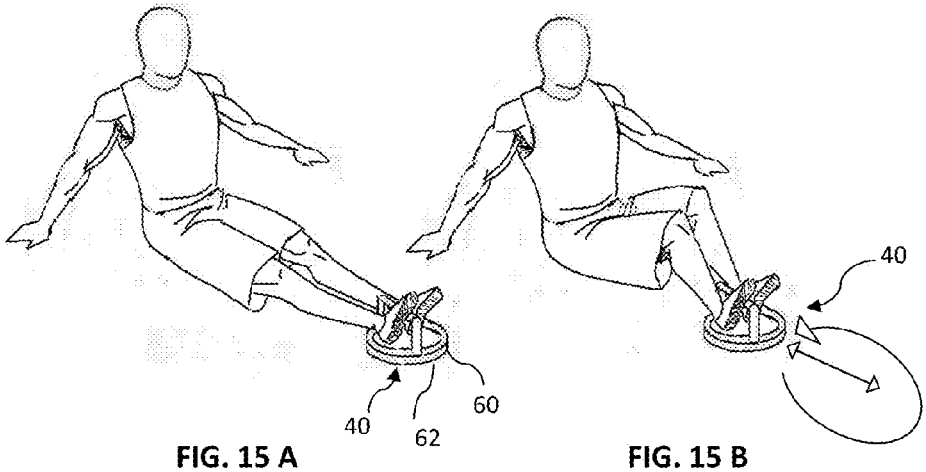
FIGS. 15A and 15B illustrate a seated linear and/or circular leg curl and extension with both feet on a single apparatus according to the inventive method and system.
Figure 16:
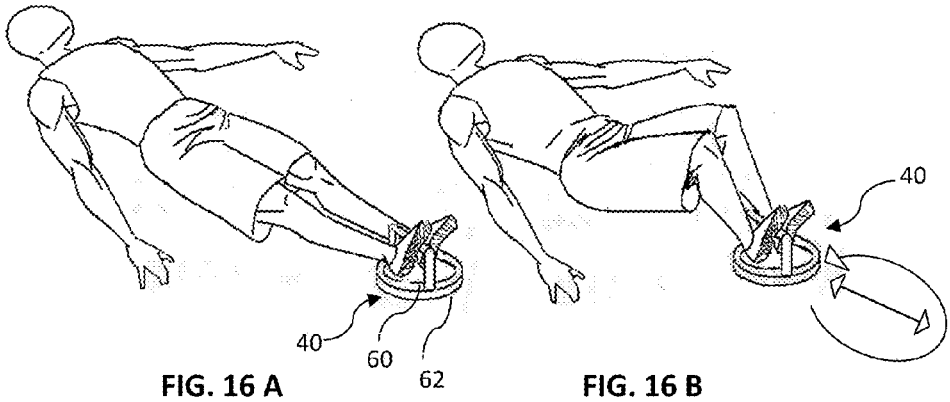
FIGS. 16A and 16B illustrate a supine linear and/or circular leg curl and extension with both feet on a single apparatus according to the inventive method and system.

FIG. 13C illustrates a seated circular leg curl and extension for one leg. This exercise starts in a seated position with the right knee flexed, both hands on the exercise floor to support the torso and the left knee extended with the left heel on apparatus 40. The user bends the left knee by circularly sliding apparatus 40 to circle out, and curling the left heel to the seated position. He then extends the left knee by circularly sliding out apparatus 40 to circle in and pushing the left heel out to the seated position. During the circular slide, platform 60 rotates with respect to the base 62 while the heel is secured on the platform.

FIGS. 14A and 14B illustrate a seated adductor/abductor and lower abs exercise using an apparatus 40 on each foot. This exercise starts in a seated position with the knees slightly bent, both hands on the exercise floor to support the torso and the feet spread apart as far as the flexibility of the user can allow him to stretch. The user linearly or circularly slides in both apparatuses 40 together to pull in the heels to the seated position. The user then linearly or circularly slides out both apparatuses 40 as far his flexibility will allow while pushing out the heels to the seated position.

FIGS. 15A and 15B illustrate a seated linear and/or circular double leg curl and extension with both feet on a single apparatus 40. This exercise starts in a seated position with both hands on the exercise floor to support the torso and the knees extended with the heels on the apparatus 40. The user bends the knees by linearly or circularly sliding apparatus 40 to curl the heels to the seated position. He then extends the knees by linearly or circularly sliding apparatus 40 to push the heels out to the seated position.

FIGS. 16A and 16B illustrate a supine linear and/or circular leg curl and extension with both feet on a single apparatus 40. This exercise starts in a supine position with the arms along the body, the hands on the exercise floor and the knees extended with both heels on apparatus 40. The user bends the knees by linearly or circularly sliding apparatus 40 to curl the heels to the supine position. He then extends the knees by linearly or circularly sliding apparatus 40 to push the heels out to the supine position.

Figure 17A:
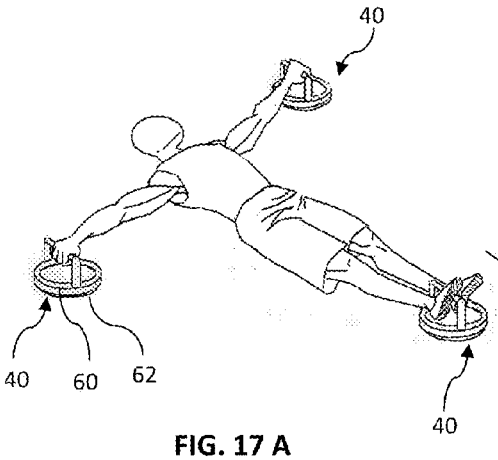
FIGS. 17A and 17B illustrate the use of three apparatuses to perform a crunch combine with a supine leg curl and extension according to the inventive method and system.
Figure 17B:
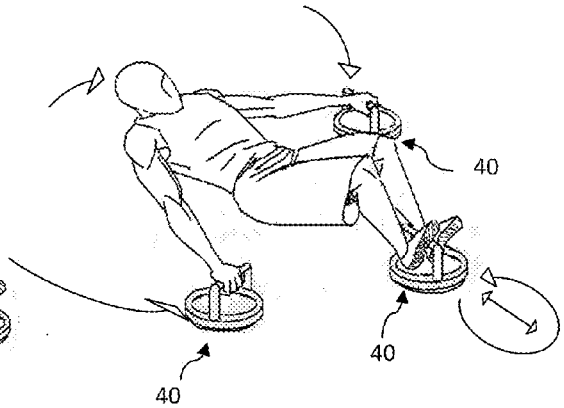

FIGS. 17A and 17B illustrate the use of three apparatuses 40 to perform a crunch combine with a supine leg curl and extension. This exercise starts in a supine-cross position with both arms perpendicular to the body with an apparatus 40 on each hand, the knees extended with both heels on apparatus 40. The user performs a crunch while circularly sliding down both apparatuses 40 along his body and bending the knees by linearly or circularly sliding apparatus 40 to curl the heels to the supine position. He then circularly slides both apparatuses 40 back up so his arms are perpendicular to the body and extends the knees by linearly and/or circularly sliding apparatus 40 to push the heels out to the supine position.

Figure 18A:
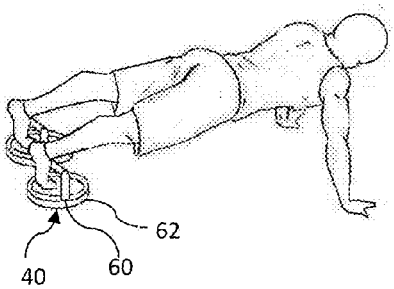
FIGS. 18A and 18B illustrate a prone adductor/abductor and lower abs exercise according to the inventive method and system.
Figure 18B:
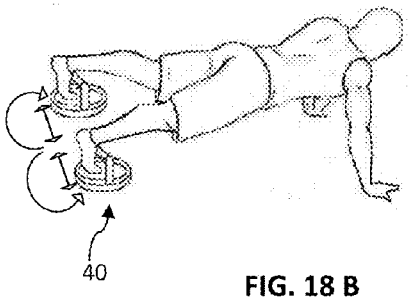

FIGS. 18A and 18B illustrate a prone adductor/abductor and lower abs exercise with an apparatus 40 secured on each foot. This exercise is shown starting from the push-up position with both hands on the exercise floor and the feet close together so both apparatuses 40 touch one another with the knees extended. The user linearly or circularly slides in both apparatuses together keeping the knees extended, and pushing out both apparatuses 40 by pushing on the toes to get to the push-up position while stretching as far his flexibility will allow him. The user then linearly or circularly slides in both apparatuses 40 keeping the knees extended and pulling on the toes to get to the push-up position.

Figure 18C:
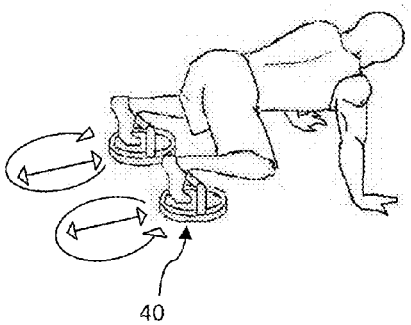
FIG. 18C illustrates a reverse crunch sliding two apparatuses with linear and circular patterns according to the inventive method and system.

FIG. 18C illustrates a prone reverse crunch sliding two apparatuses 40 with linear and circular patterns. This exercise starts from the push-up position with both hands on the exercise floor and the feet close together so both apparatus 40 can touch one another with the knees extended and the toes on apparatus 40. The user linearly or circularly slides in both apparatuses together pulling the toes toward his waist while bending the knees to finish in the prone position. The user then linearly or circularly slides out both apparatuses 40 extending the leg out and pushing on the toes to get back to the push-up position.

Figure 19:
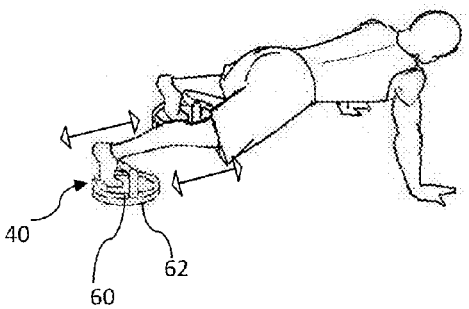
FIG. 19 illustrates a mount climber exercise according to the inventive method and system.

FIG. 19 illustrates a mountain climber exercise with an apparatus 40 on each foot. This exercise starts from the push-up position with both hands on the exercise floor, the left knee bent with the left toes on apparatus 40 and the right knee extended with the right toes on the second exercise apparatus 40. The user then linearly slides apparatus 40 of the left foot back and linearly slides apparatus 40 of the right foot up toward the hips. The user performs this exercise by sliding both apparatuses 40 back and forth, i.e., the left leg and then the right leg.

Figure 20A:
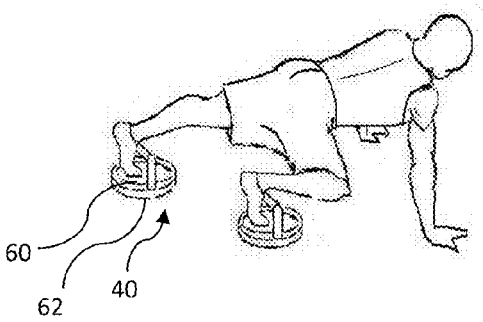
FIGS. 20A and 20B illustrate a single leg mount climber with circular patterns according to the inventive method and system.
Figure 20B:
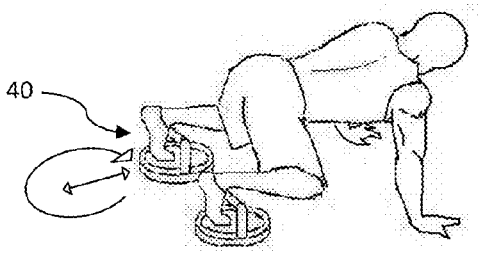

FIGS. 20A and 20B illustrate a single leg mountain climber with linear and circular patterns. This exercise starts from the push-up position with both hands on the exercise floor, the right knee bent with the right toes on apparatus 40 and the left knee extended with the left toes on the second exercise apparatus 40. The user keeps the right knee bent and then linearly or circularly slides the left foot forward pulling the apparatuses 40 while keeping the right knee bent. The user then linearly slides the left foot backward.

Figure 21A:
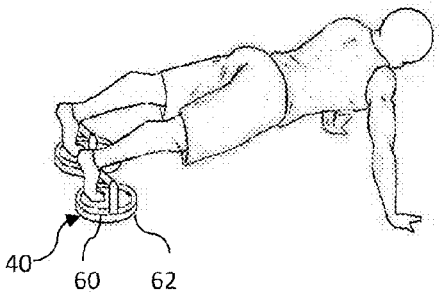
FIGS. 21A and 22B illustrate a prone stiff leg reverse crunch with linear and circular patterns according to the inventive method and system.
Figure 21B:
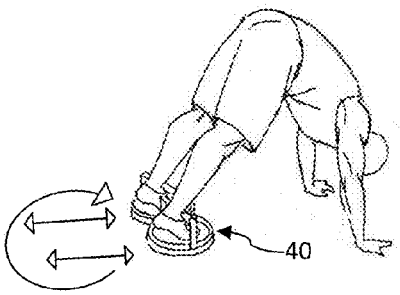

FIGS. 21A and 21B illustrate a prone stiff leg reverse crunch with linear and circular patterns. This exercise is shown starting from the push-up position with both hands on the exercise floor and the feet close together so both apparatus 40 touch one another with the knees extended. The user linearly or circularly slides in both apparatuses together keeping the knees extended, pulling on the toes and bringing the apparatuses 40 up. The user then pushes back on the toes to slide back both apparatuses 40 in linear or circular patterns to return to the push-up position.

Figure 22A:
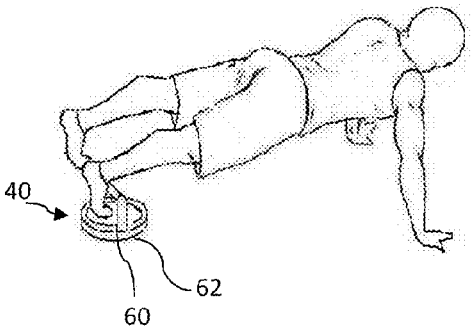
Figure 22B:
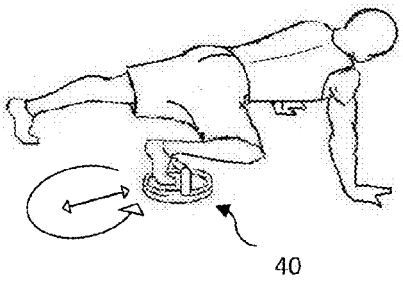

FIGS. 22A and 22B illustrate a single leg mountain climber with linear and circular patterns and using a single apparatus 40. This exercise is shown starting from the push-up position with both hands on the exercise floor with the legs extended and the right toes on a single apparatus 40 while the left toes stay on the exercise floor. The user keeps the left leg extended and slides up apparatus 40 in a linear pattern by bending the right knee. The user then slides back apparatus 40 in a linear pattern to push the right foot back to the push-up position.

Figure 23A:
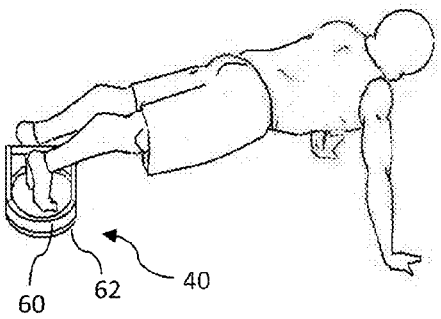
FIGS. 23A and 23B illustrate a reverse crunch sliding a single apparatus with linear and circular patterns according to the inventive method and system.
Figure 23B:
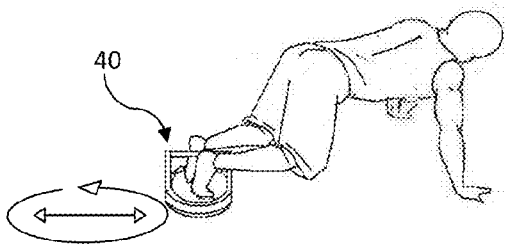

FIGS. 23A and 23B illustrate a reverse crunch sliding a single apparatus 40 with linear and circular patterns. This exercise is shown starting from the push-up position with both hands on the exercise floor and the feet close together on a single apparatus 40 with the knees extended and the toes on apparatus 40. The user slides apparatus 40 in a linear or circular pattern to pull the toes toward his waist while bending the knees to finish in the prone position. The user then slides out the apparatus 40 in a linear or circular pattern extending the leg out and pushing on the toes to get back to the push-up position.

Figure 23C:
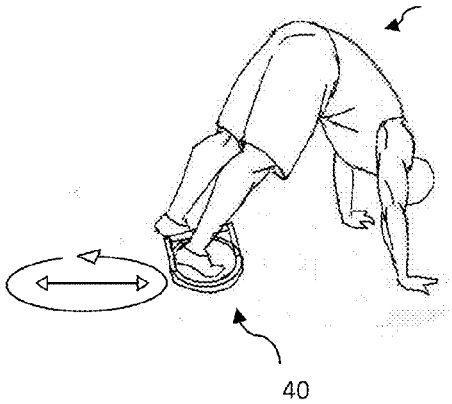
FIG. 23C illustrates a prone stiff leg reverse crunch sliding a single apparatus with linear and circular patterns according to the inventive method and system.

FIG. 23C illustrates a prone stiff-leg reverse crunch sliding a single apparatus 40 with linear and circular patterns. This exercise starts from the push-up position with both hands on the exercise floor and the feet close together on a single apparatus 40 with the knees extended and the toes on apparatus 40. The user slides apparatus 40 in a linear or circular to pull the toes toward his waist while keeping the knees extended to finish in the prone position. The user then slides out apparatus 40 in a linear or circular pattern while pushing on the toes to get back to the push-up position.

Figure 23D:
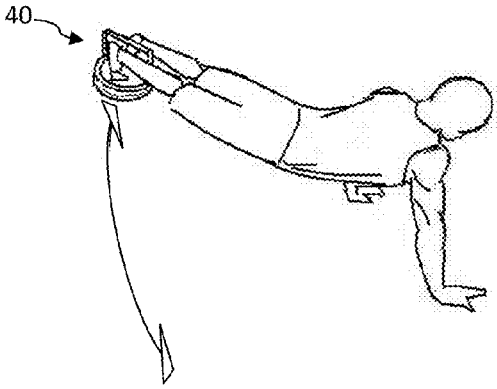
FIG. 23D illustrates a prone stiff leg oblique twist sliding a single apparatus from left to right in linear and circular patterns according to the inventive method and system.

FIG. 23D illustrates a prone stiff-leg oblique twist sliding a single apparatus from left to right in a half circular pattern. This exercise starts from the push-up position with both hands on the exercise floor and the feet close together on a single apparatus 40 with the knees extended and the toes on apparatus 40. The user slides apparatus 40 in a circular pattern to slide apparatus 40 sideways going right. The user then slides apparatus 40 sideways towards the left to bring the body to the push-up position.

Figure 24A:
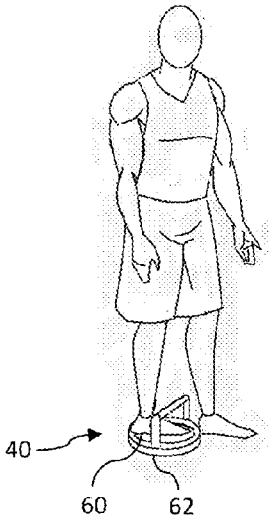
FIGS. 24A and 24B illustrate a reverse lunge sliding a single apparatus back and forth in linear and circular pattern according to the inventive method and system.
Figure 24B:
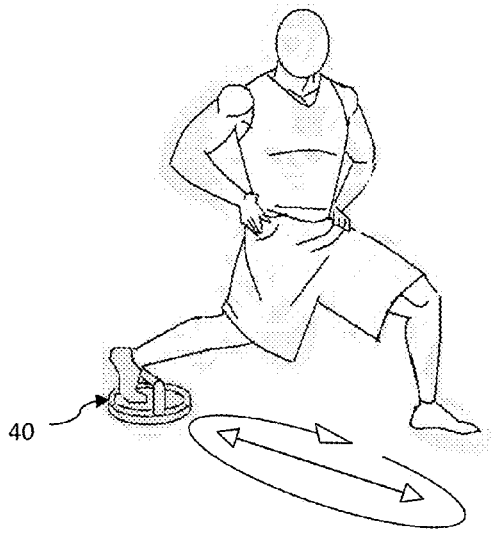

FIGS. 24A and 24B illustrate a reverse lunge sliding a single apparatus 40 back and forth in a linear pattern and/or circular pattern. This exercise is shown starting from a standing rest position with an apparatus 40 secured under one foot. The user begins to slide the right foot backward in a linear pattern and/or a circular pattern to a reverse lunge position, with both hands on his waist. As the right knee is bent at 90 degrees under the body, the right heel is raised up on top of apparatus 40 to balance and support the user's weight on the ball and toes of the right foot. The left knee is also lowered at 90 degrees in front of the body as the hips are lowered to a reverse lunge position. The user then returns to an upright standing position by sliding forward apparatus 40 of the right foot in linear pattern and/or circular pattern.

Figure 24C:
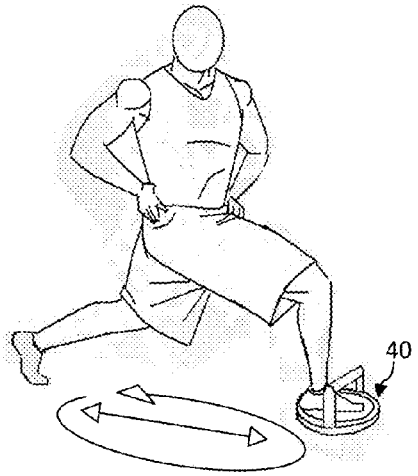
FIG. 24C illustrates a lunge sliding a single apparatus forward and backward in linear and circular pattern according to the inventive method and system.

FIG. 24C illustrates a front lunge sliding a single apparatus 40 forward and then backward in linear pattern and/or circular pattern. This exercise starts from a standing rest position with an apparatus 40 secured under one foot. The user begins to slide the right foot forward in a linear pattern and/or a circular pattern to a front lunge position with both hands on his waist. As the left knee is bent at 90 degrees, the left heel is raised up to balance and supports the user's weight on the ball and toes of the left foot. The right knee is also lowered at 90 degrees as the hips are lowered to a front lunge position. The user then returns to an upright standing position by sliding backward apparatus 40 of the right foot in linear pattern and/or circular pattern.

Figure 24D:
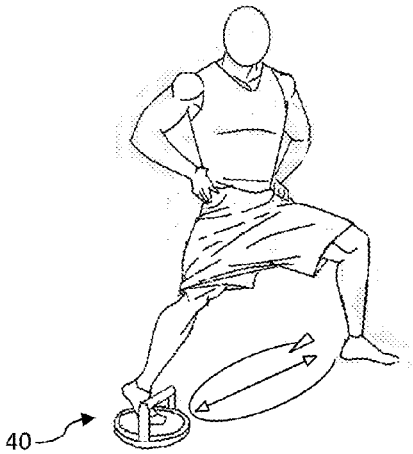
FIG. 24D illustrates a side lunge sliding a single apparatus sideways in linear and circular pattern according to the inventive method and system.

FIG. 24D illustrates a side lunge sliding a single apparatus 40 sideways in linear pattern and/or circular pattern. This exercise starts from a standing rest position with an apparatus 40 secured under one foot. The user begins to slide the right foot sideways in a linear pattern and/or a circular pattern to a side lunge position, with both hands on his waist. As the right knee is slightly bent, the right heel is progressively raised up to balance and supports the user's weight on the ball and toes of the right foot. The left knee is bent at 90 degrees under the body as the hips are lowered to the side lunge position. The user then returns to an upright standing position by sliding apparatus 40 back in toward the body in linear pattern and/or circular pattern.

According to various embodiments, the apparatus can be used as a single apparatus only or more than one apparatus (e.g. four apparatuses) at a time to exercise and/or stretch. The apparatus can be used by a single user or by a large group of users, for example, a fitness class, a team, group training, seminars and the like. The different uses of the apparatus can be taught to a single person or to a group of people in classes, seminars and the like.

According to various embodiments of the method and system of the present invention, the system can be used while the user is wearing a weighted vest, weighted belt, or ankle weights. The use of dumbbells, barbells, or resistance bands can also be incorporated to increase the resistance while sliding the apparatus. The apparatus can be used with other exercise tools to promote more balance, such as a Swiss ball, a medicine ball, a balance board, a BOSU® ball, and the like. For example, the user can hold an apparatus on one hand and have the other hand on a medicine ball to challenge the body for balance.

According to various embodiments, the method and system of the present invention can include one or more kneepads to promote comfort on the knees for any stretches and/or exercises that the user would perform on his knees.

Figure 25:
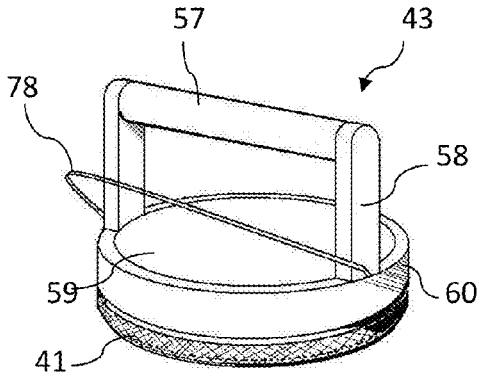
FIG. 25 illustrates a perspective view of an alternative embodiment of the inventive method and system with an elastic band to secure a limb on the apparatus.

FIG. 25 illustrates another embodiment of the inventive method and system. An apparatus 43 includes a band 78, such as an elastic band or a strap, to secure a limb to platform 60. Apparatus 43 offers the option of elastic band 78 used as a strap to secure the foot to platform 60 so the user can slide apparatus 43 at a different speed and with more control. If the user has the toes on platform 60, the elastic band 78 can go over the heel to secure the foot; if he has the heel on platform 60, the elastic band 78 can go over the foot.

Figure 26:
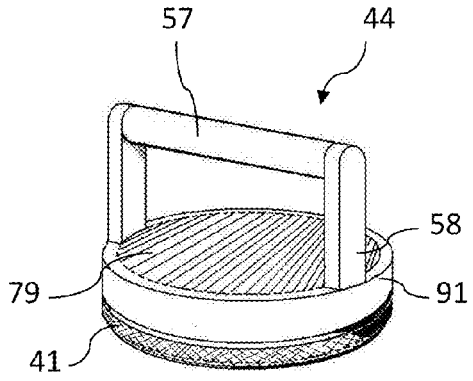
FIG. 26 illustrates a perspective view of an alternative embodiment of the inventive method and system with a slip resistant pattern engraved on the platform.

FIG. 26 illustrates another embodiment of the inventive method and system. An apparatus 44 has a slip resistant pattern 79 on the top surface of a platform 91 to receive the limb. Apparatus 44 offers an option of slip resistant pattern 79 engraved on platform 91 instead of a slip resistant mat 59. Slip resistant pattern 79 can be designed to receive a limb of the body in different positions such as the bottom of the foot, the heel, or the toes (see also, FIG. 5B). The designed patterns can include indentions wide enough to receive and secure the feet, the toes or heels.

Figure 27:
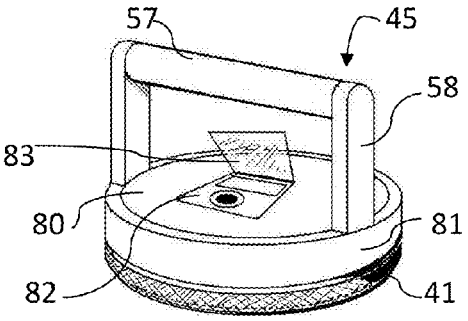
FIG. 27 illustrates a perspective view of an alternative embodiment of the inventive method and system with a miniature video and/or music apparatus secured on the platform.

FIG. 27 illustrates another embodiment of the inventive method and system. An apparatus 45 incorporates an electronic device such as a miniature video and/or music device 82 secured to a platform 81. Apparatus 45 can have a slip resistant mat 80 with an opening designed to receive miniature video and/or music device 82. Platform 81 can have an opening designed to receive miniature video and/or music device 82 and a transparent cover 83 designed to protect miniature video and/or music device 82. Apparatus 45 offers this option so the user can play music or watch the exercise of his training program while exercising. The training program can be provided separately, for example, with an option of uploading the desired program on apparatus 82.

Figure 28:
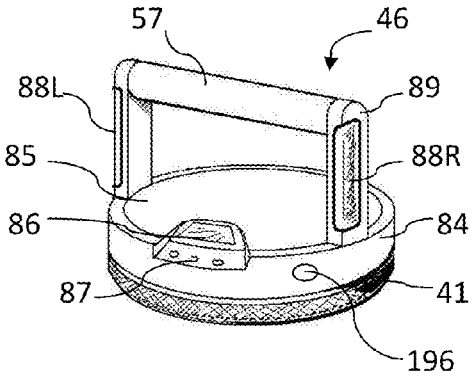
FIG. 28 illustrates a perspective view of an alternative embodiment of the inventive method and system with a body composition reader incorporated into the apparatus.

FIG. 28 illustrates another embodiment of the inventive method and system. An apparatus 46 incorporates a body composition reader 86. Apparatus 46 as a platform 84 designed to receive body composition reader 86 and a slip resistant mat 85 with an opening on the side designed to allow access to the body composition reader 86 and control buttons 87. The body composition reader can comprise two receptors 88R and 88L on a gripping bar 89, designed to be held by the hands so an electric charge can come out of the receptor 88R through the right hand and travel the entire body back out through the left hand and go back through the left receptor 88L. The rate of return of the electric charge from receptor 88R through 88L is used to determine the body fat percentage and determine the body composition. The age, gender, weight, height, and activity level can be entered with control buttons 87 so the body composition reading is accurate. A battery compartment 196 can hold different types of batteries to power the body composition system.

Figure 29:
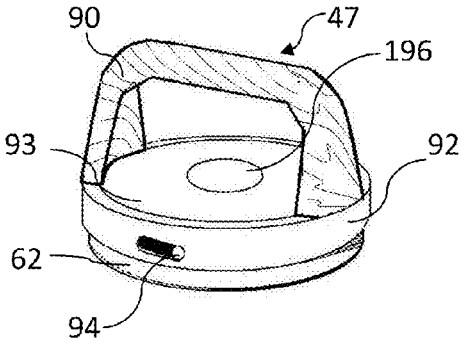
FIG. 29 illustrates a perspective view of an alternative embodiment of the inventive method and system with a vibrating system incorporated into the apparatus.

FIG. 29 illustrates another embodiment of the inventive method and system. An apparatus 47 includes an incorporated vibrating system. The vibrating system is adapted to vibrate apparatus 47 during use. Apparatus 47 has a gripping bar 90, a slip resistant mat 93, and a platform 92 designed to carry the vibrating system turned on and off by a switch 94. The vibrating system is an option that provides extra muscle recruitment for balance and stability, which will improve muscle reaction, recruitment and reflexes. This system can also be used to improve flexibility by holding apparatus 47 with a limb while stretching. Switch 94 can control different vibration intensity levels.

Figure 30:
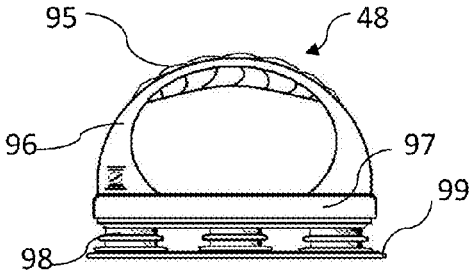
FIG. 30 illustrates a perspective view of an alternative embodiment of the inventive method and system with a shock absorbing system incorporated into the apparatus.

FIG. 30 illustrates another embodiment of the inventive method and system. Apparatus 48 includes a shock absorbing system 98 adapted to cushion the limb during use. Shock absorbing system 98 can comprise a cushioning material with impact absorbing properties positioned between platform 97 and base 99. Apparatus 48 can have a gripping bar 96 with soft handles 95 designed with a cushioning material having impact absorbing properties, a platform 97 rotatably mounted on shock absorbing system 98 and a base 99. Apparatus 48 is designed for ballistic type of training involving, for example, plyometric pushups, which can hurt the wrists and elbow after every landing. Apparatus 48 can use various types of shock absorbing systems, for example, gel padding, air system, and springs. The shock absorbing system can be placed in any appropriate location in apparatus 48 as long as it does not interfere with the limb gripping apparatus 48.

FIG. 31 illustrates another embodiment of the inventive method and system. Apparatus 49 includes a half Swiss ball 100 platform shape. Apparatus 49 has half Swiss ball 100 positioned on platform 101 and is designed to receive a limb while providing balance stimulus to improve stability and muscle balance. Apparatus 49 can be used with half Swiss ball 100 facing up or down. Apparatus 49 with half Swiss ball 100 facing up as shown can be used for linear and circular movement patterns while providing balance challenges to the body. Alternatively, half Swiss ball 100 can be used on base 62 facing down (not shown). With half Swiss ball 100 facing down the user is provided with an additional balance challenge.

FIG. 32 illustrates another embodiment of the inventive method and system. Apparatus 50 includes a cushioned slip resistant pad 102 placed on top of a platform 104 designed to secure pad 102 and a gripping bar 103. Pad 102 can be removable from platform 104 and can then be placed on the floor, for example, to serve as a kneeling pad to promote comfort to the knee. The cushioned pad 102 can also be used with apparatus 50 and provide improved comfort for a limb such as a foot, hand or knee. Apparatus 50 can improve comfort while exercising in linear and circular patterns. Apparatus 50 can be used for linear and circular movement patterns while the limb is comfortably secured on pad 102 in multiple planes of motion and position. This embodiment can provide an apparatus with a storable and multipurpose pad.

FIGS. 33A, 33B, 33C and 33D illustrate another embodiment of the inventive method and system. Apparatus 51 includes a pivotable gripping bar 107. Gripping bar 107 is U-shaped and is connected to platform 105 at two connection points 106R and 106L. Gripping bar 107 is pivotable along an axis defined by connection points 106R and 106L.

A gripping bar that is pivotable allows for using both sides of apparatus 51. Gripping bar 107 can be positioned on the same side of the Swiss ball 100 as shown in FIG. 33A. Gripping bar 107 can also be pivoted as shown in FIG. 33B. Gripping bar 107 can be pivoted from one side of apparatus 51 to the other, as shown in FIG. 33C. In apparatus 51, gripping bar 107 can be pivoted so that apparatus 51 can be held with half Swiss ball 100 facing down as shown in FIG. 33D.

Figure 34A:
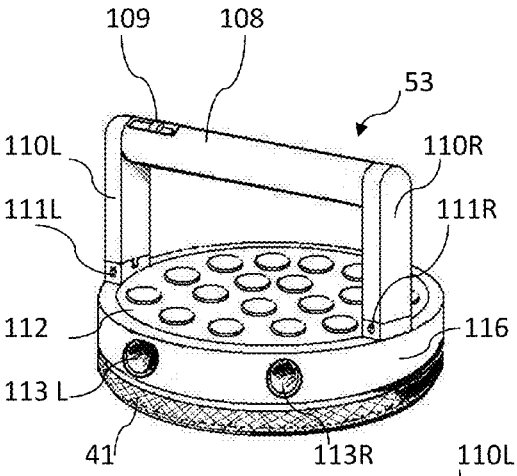
FIGS. 34A, 34B, 34C and 34D illustrate a perspective view of an alternative embodiment of the inventive method and system with a collapsible apparatus.
Figure 34B:
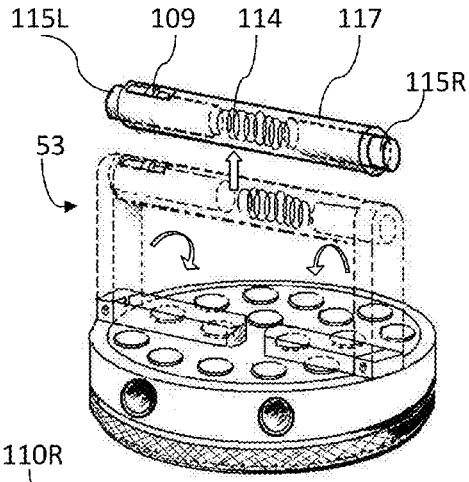
Figure 34C:
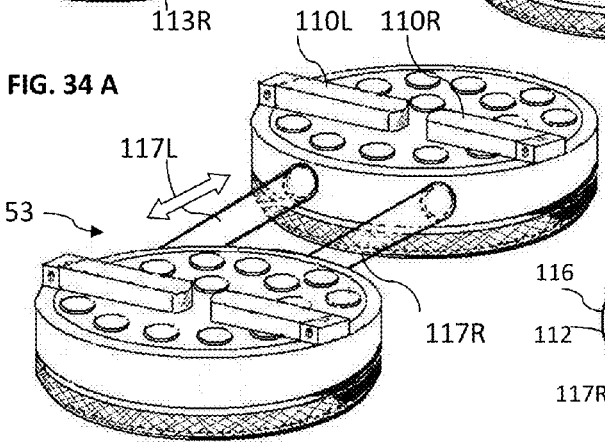
Figure 34D:
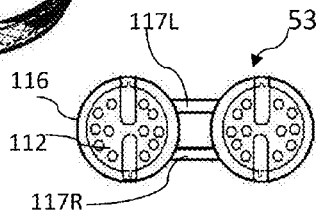

FIGS. 34A, 34B, 34C and 34D illustrate another embodiment of the inventive method and system. Apparatus 53 is collapsible, for example, for storage and traveling. Apparatus 53 comprises a collapsible gripping bar 108. Gripping bar 108 comprises a detachable handle 117 spanning between a left pole 110L and a right pole 115R. Detachable handle 117 can comprise inside tubes 115L and 115R held by a spring 114. A connecting switch 109 can retract spring 114 on the inside to unlock the left side of detachable handle 117 out of the left pole 110L and then out of the right pole 110R, as shown in FIGS. 34A and 34B. Gripping bar 108 also comprises a collapsible left pole 110L and collapsible right pole 110R connected to platform 116. Collapsible poles 110L and 110R can be collapsed through their respective axes 111L and 111R down to the top 112 of the platform 116. Platform 116 has two holes 113L and 113R adapted to receive detachable handle 117R from one apparatus 53 and detachable handle 117L from second apparatus 53 so apparatuses can be attached together as shown in FIGS. 34C and 34D.

Figure 35A:
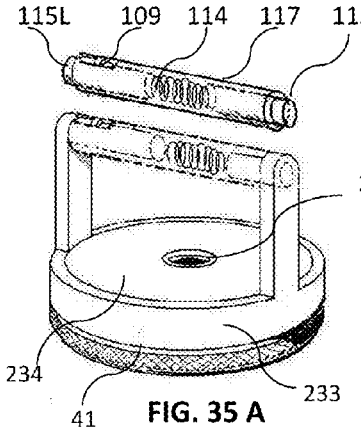
FIGS. 35A, 35B and 35C illustrate a perspective view of an alternative embodiment of the inventive method and system with an apparatus having a removable hand gripping bar that can be secured vertically in the middle of the platform.
Figure 35B:
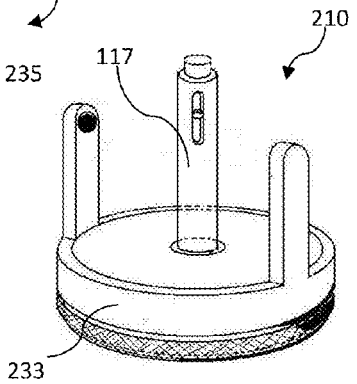
Figure 35C:
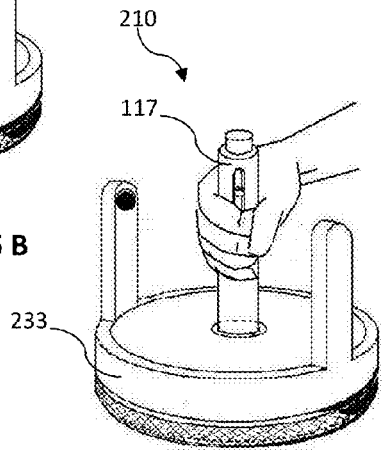

FIGS. 35A, 35B and 35C illustrate another embodiment of the inventive method and system. Apparatus 210 comprises a detachable handle 117 that can be secured vertically in a central hole 235 of platform 233. In this apparatus, the detachable handle 117 provides a vertically oriented pole connected to the center of the platform. This configuration can provide a different way to hold apparatus 210 while exercising and stretching. Detachable handle 117 can comprise inside tubes 115L and 115R held by spring 114. A connecting switch 109 can retract spring 114 on the inside to unlock detachable handle 117. Detachable handle 117 can be secured into platform 233 by central hole 235 as shown in FIG. 35B. In this configuration, the user can grip apparatus 210 with the vertically oriented handle 117. This feature allows moving apparatus 210 with more force and offers pulling angles similar to holding onto a pole, as shown in FIG. 35C.

Figure 36A:
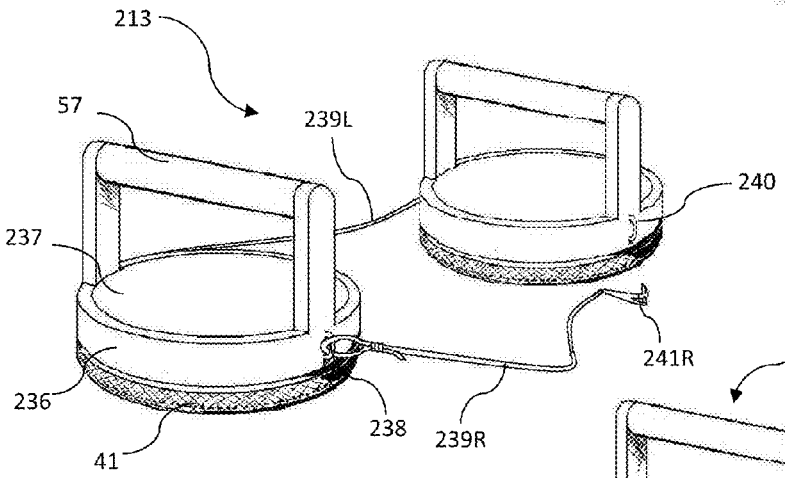
FIGS. 36A and 36B illustrate a perspective view of an alternative embodiment of the inventive method and system with a resistant band that can connect two apparatuses together and/or a single apparatus to another source.
Figure 36B:
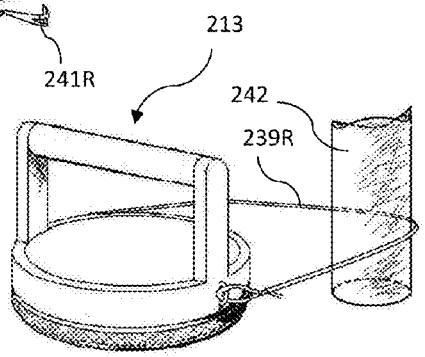

FIGS. 36A and 36B illustrate another embodiment of the inventive method and system. This embodiment includes apparatuses 213 and 214 with one or more resistant band 239R and 239L that can connect two apparatuses 213 together and/or a single apparatus 214 to another source such as a pole 242. Apparatus 213 and 214 with resistance band 239R and/or 239L allows for the exercises and/or stretches to be performed with the "assistance" of resistance, in that the resistance helps to pull one apparatus 214 and/or both apparatuses 213 back, and also works the muscle groups involved harder as the limb of the body is pushed outward. The exercises are essentially the same in using the resistance, except that the resistance can be used (depending upon the exercise) to either increase or decrease the difficulty.

Apparatus 213 has a ring 238 and 240 designed to attach resistance band 239R, for example by a loop or a hook 241R. With two apparatuses, resistance band 239R can be hooked from one apparatus 213 to the other one, for example, as shown in FIG. 36A. The apparatus 214 shown in FIG. 34B has resistance band 239R going around pole 242 and then hooked back onto receiving ring 240 so that the user can pull and/or push from pole 242 while exercising.

FIGS. 37A and 37B illustrate another embodiment of the inventive method and system. Apparatus 215 includes a removable slip resistant mat 248 that extends down to cover the entire platform 247. A removable gripping bar 243 can secure mat 248 and can be removed to allow changing of mat 248. Mat 248 is secured over platform 247 while openings 257R and 257L of mat 248 are placed right above openings 246R and 246L of platform 257 to allow sliding in the hooked extremities 245R and 245L of gripping bar 243 and to snap in gripping bar 243 onto platform 247. The snapping system is designed to be locked when gripping bar 243 is snapped onto platform 247. The snapping system can be unlocked by putting pressure on the side buttons 244R and 244L to push in the right hook 245R and the left hook 245L respectively, then gripping bar 243 can be pulled out of platform 247. Mat 248 can have different shapes, colors, design patterns on its surface, writings such as slogans, sports teams, brands, logos, etc.

FIGS. 38A, 38B, 38C and 38D illustrate another embodiment of the inventive method and system. Apparatus 216 can include a removable gripping bar 217 with a vibrating system incorporated therein. The vibrating system can provide vibration as a stimulus and can be triggered by a switch 219. The vibrating system can provide additional muscle stimulation when using apparatus 216.

Gripping bar 218 includes an offset base having the extremities 245 (L&R) and 249 (L&R). The extremities 245 (L&R) and 249 (L&R) are aligned vertically with the handheld portion of the gripping bar 218 and are secured to platform 221. Platform 221 can include one or more openings 250 (L&R) and 251 (L&R) for securing gripping bar 218 to platform 221. The one or more openings 250 and 251 can be included on platform 221 to allow positioning of gripping bar 218 in a variety of positions on platform 221 to accommodate limbs of various sizes. Gripping bar 218 can include right and left extremities and each extremity can have a V shape. Each extremity can then be connected to platform 221 at two connection points, 245R and 249R, and 244L and 249L.

As shown for example in FIG. 38D, when extremities 245 (L&R) are secured to platform 221 by openings 250 (R&L), gripping bar 218 is offset on apparatus 216 and provides more room, for example, to better accommodate gripping by the foot. Other combinations of openings and connection points can be used to position gripping bar 218.

FIG. 38A also shows another embodiment of apparatus 216 having an offset gripping bar 218. Mat 201 is secured over platform 221 while openings 299R and 299L of mat 201 are placed above openings 250 (R&L) and 251 (R&L) of platform 221. Hooked extremities 245 (R&L) and 249 (R&L) of gripping bar 218 can slide in to openings 250 and 251 (R&L) and snap gripping bar 218 to platform 221. The snapping system is designed to be locked when gripping bar 218 is snapped onto platform 221. The snapping system can be unlocked by putting pressure on a side button 244R and 244L to push in the right hook 245R and the left hook 245L respectively, then gripping bar 218 can be pulled out of platform 221. Mat 201 can have different shapes, colors, patterns designs or writings such as slogans, sports teams, brands, logos, etc.

FIGS. 39A, 39B and 39C illustrate another embodiment of the inventive method and system. Apparatus 220 includes one or more multidirectional wheels 253. Platform 91 is rotatably connected to a base 252 having holes 254 designed to receive multidirectional wheels 272. Multidirectional wheels 253 can be removable so that base 252 can slide on a surface. Wheels 253 can be covered by a rubber surface having a friction coefficient that can be altered to produce a greater resistance or a smaller resistance to accommodate any user. Apparatus 220 can include a slip resistant pattern 79 engraved in platform 91.

FIGS. 40A, 40B and 40C illustrate another embodiment of the inventive method and system. Apparatus 223 includes a removable sliding base 256. Platform 60 is rotatably connected to a base 255 having openings 258 designed to receive plugs 202 on removable sliding base 256. Removable base 256 can be designed to slide on soft surfaces; further designs can be used, for example, with a pluggable nylon base for glossy surfaces or a pluggable wheeled base for slip resistant surfaces. One advantage of this embodiment is that the pluggable base can be easily replaced or substituted. The system can include a plurality of removable slideable bases, and each base can provide a different coefficient of friction with the contacted surface.

While the above description contains much specificity, this should not be construed as limitations on the scope of the present invention, but rather as an exemplification of embodiments of the invention.

Further embodiments of the system and method of realigning the joints while performing circular and linear movement patterns are different than the above exemplified field of fitness and exercise. Alternative embodiments include, for example, an apparatus to clean a surface, such as a wall or countertop or a car, while protecting the joints involved in the cleaning movement and pattern. The same will be true for an alternative embodiment with a bottom adapted to have a brush to clean, or paint, or a bottom adapted to have a removable cloth with different cleaning properties such as absorbing and holding liquid, or a bottom adapted to iron clothes with an electric component to control the temperature. It is clear to those of ordinary skill in the art that the field of daily activity could determine and influence the proper changes to an apparatus to fit into a specific field within the scope of the present invention allowing joint realignment for any activity with circular and linear movement patterns.

It is evident that the method and system of the present invention provides a new dimension of exercise and stretching never performed. These exercises and stretches can be marketed and sold to target specific training methods, sports, personal trainers, strength coaches, aerobics instructors, pilates/yoga instructors, athletic trainers, or physical therapists. The exercises can be taught to instructors in continuing education classes or made available through the Internet. The system and method of the present invention contemplates that a video tape, DVD, or other recorded image of the exercise routines can be sold and/or downloaded, for example, for playback on a computer, an iPod or other type of apparatus capable of playing video.

Certain changes can be made in the systems and methods disclosed herein without departing from the scope of the present invention. Consequently, it is intended that all subject matter contained in the above description or shown in the accompanying drawings be interpreted as illustrative and not in a limiting sense.

The invention claimed is:

1. A linear and circular movement system, comprising a limb-activated, linearly and circularly moveable apparatus comprising:

i) a gripping device adapted for gripping by a limb;

ii) a rotatable platform connected to the gripping device, the platform being rotatable by a first movement of the limb with the limb gripping the gripping device;

iii) a pivoting element connected to said platform; and iv) a sliding base connected to said pivoting element, the base being removable from the apparatus, the base comprising a low friction coefficient bottom surface, the base being smoothly slideable across a contacted surface in contact with the bottom surface, the sliding base in contact with the contacted surface having a friction coefficient permitting the sliding when a person presses the apparatus at an oblique angle, the base being slideable by a second movement of the limb with the limb gripping the gripping device, wherein the system comprises a plurality of removable sliding bases, each base providing a different coefficient of friction with the contacted surface, wherein the first and second movements of the limb with the limb gripping the gripping device actuates the platform and base to realize both linear and circular motion of the apparatus with respect to the contacted surface.

2. The system of claim 1, wherein, the system comprises four of said apparatus, said gripping device of a first two of said apparatus is adapted for gripping by a foot, and said gripping device of a second two of said apparatus is adapted for gripping by a hand.

3. The system of claim 1, wherein the apparatus further comprises a slip resistant mat positioned on the platform to receive the limb gripping the gripping device.

4. The system of claim 3, wherein the slip resistant mat is removable from the platform.

5. The system of claim 1, wherein the apparatus further comprises a strap to secure the limb to the platform.

6. The system of claim 1, wherein the platform comprises a slip resistant pattern on a top surface of the platform to receive the limb gripping the gripping device.

7. The system of claim 1, wherein the platform comprises indentations adapted to receive and secure the limb gripping the gripping device.

8. The system of claim 1, further comprising a vibrating system incorporated into the apparatus and adapted to vibrate the apparatus during use.

9. The system of claim 1, further comprising a shock absorbing system incorporated into the apparatus and adapted to cushion the limb gripping the gripping device during use.

10. The system of claim 1, further comprising a half ball positioned on the platform.

11. The system of claim 1, wherein the gripping device comprises a gripping bar connected to the platform.

12. The system of claim 11, wherein the gripping bar is U-shaped and is connected to the platform at two connection points.

13. The system of claim 12, wherein the gripping bar is pivotable along an axis defined by the two connection points.

14. The system of claim 11, wherein the gripping bar comprises a collapsible left pole connected to the platform, a collapsible right pole connected to the platform, and a detachable handle spanning between the left pole and the right pole.

15. The system of claim 11, wherein the gripping bar is detachable from the apparatus.

16. The system of claim 11, wherein the gripping bar comprises a vertically oriented pole connected to the platform.

17. The system of claim 1, further comprising a strap connected to the apparatus.

18. The system of claim 1, comprising two of said apparatus connected to each other by a strap.

19. The system of claim 18, wherein the strap is an elastic resistance band.

20. The system of claim 1, wherein the apparatus further comprises a removable boot adapted to fit over the base.

21. The system of claim 1, wherein the apparatus is adapted to be slideable across a contacted surface that is a glossy floor, a hardwood floor, an exercise floor, or a carpeted floor, when an oblique force is applied by a person.

22. A method of performing an exercise by a human body using the system according to claim 1, comprising:

positioning the apparatus on a surface, such that the sliding base is in contact with the surface;

gripping the apparatus with at least one limb of the body;

moving the at least one limb to slide the apparatus in a linear or circular motion across the contacted surface, wherein the joints involved in the movement are continually realigned during the movement.

23. The method of claim 22, wherein the system comprises a plurality of apparatuses, positioning each apparatus on a surface, wherein the sliding base of each apparatus is in contact with the surface;

gripping each apparatus with at least one limb of the body;

moving the at least one limb to slide at least one of the plurality of apparatus in a linear or circular motion across the contacted surface.

24. The method of claim 23, wherein two limbs of the body slide two apparatus across the contacted surface.

25. The method of claim 24, wherein the two limbs of the body simultaneously slide the two apparatus.

26. The method of claim 23, wherein the two limbs are selected from two hands, two feet, two knees, one hand and one foot, one knee and one foot, and one knee and one hand.

27. The method of claim 22, wherein two limbs grip a single apparatus.

28. The method of claim 22, wherein the exercise is performed by the human body in a position selected from one of a prone position, a supine position, a side-lying position, a kneeling position, a seated position and a standing position.

29. The method of claim 22, wherein the surface is selected from one of a glossy floor, a hardwood floor, an exercise floor, a rubberized floor, and a carpeted floor.

30. The method of claim 22, further comprising attaching a strap to the apparatus, wherein the strap is adapted to provide additional resistance to the movement of the at least one limb sliding the apparatus.

31. The method of claim 22, wherein a first movement of the limb actuates a rotation of the platform of the apparatus and a second movement of the limb actuates a sliding motion of the base of the apparatus across the contacted surface.

32. A method of exercising the human body, comprising performing two or more exercises according to claim 22.

* * * * *